United States Patent [19]

Yamada et al.

[11] Patent Number: 4,590,055

[45] Date of Patent: May 20, 1986

[54] PITCH-BASED CARBON FIBERS AND PITCH COMPOSITIONS AND PRECURSOR FIBERS THEREFOR

[75] Inventors: Yasuhiro Yamada; Takeshi Imamura, both of Tosu; Hidemasa Honda, Tokyo; Toru Sawaki; Hideharu Sasaki, both of Iwakuni, all of Japan

[73] Assignee: Director-General of the Agency of Industrial Science and Technology, Tokyo, Japan

[21] Appl. No.: 525,702

[22] Filed: Aug. 23, 1983

[30] Foreign Application Priority Data

| | | | |
|---|---|---|---|
| Aug. 24, 1982 | [JP] | Japan | 57-147036 |
| Aug. 24, 1982 | [JP] | Japan | 57-147037 |
| Aug. 24, 1982 | [JP] | Japan | 57-147038 |
| Sep. 16, 1982 | [JP] | Japan | 57-161431 |

[51] Int. Cl.[4] ..... D01F 9/12

[52] U.S. Cl. ..... 423/447.4; 423/447.6; 208/22; 208/44; 264/29.2

[58] Field of Search ..... 423/447.1, 447.4, 447.6; 264/29.2; 208/22, 44

[56] References Cited

U.S. PATENT DOCUMENTS

| | | | |
|---|---|---|---|
| 4,036,731 | 7/1977 | Martin | 208/8 |
| 4,197,283 | 4/1980 | Crepaux et al. | 423/447.1 |
| 4,272,501 | 6/1981 | Greskowich et al. | 423/447.4 |
| 4,330,394 | 5/1982 | Newman | 208/23 |
| 4,376,747 | 3/1983 | Nazem | 264/176 F |
| 4,391,788 | 7/1983 | Uemura et al. | 423/447.6 |
| 4,397,830 | 8/1983 | Uemura et al. | 423/447.1 |
| 4,431,623 | 2/1984 | Fug | 423/447.1 |

FOREIGN PATENT DOCUMENTS

| | | | |
|---|---|---|---|
| 54437 | 6/1982 | European Pat. Off. | 208/22 |
| 58-18421 | 2/1983 | Japan | 264/29.2 |

*Primary Examiner*—William R. Dixon, Jr.
*Assistant Examiner*—Steven Capella
*Attorney, Agent, or Firm*—Brisebois & Kruger

[57] ABSTRACT

The invention provides carbon fibers having mechanical properties equivalent to or even better than those of the polyacrylonitrile-based carbon fibers from a bituminous material, e.g. coal tar pitch, as the starting material. The starting pitch is first partially hydrogenated in tetrahydroquinoline under specific conditions followed by a heat treatment to give a pitch composition suitable for spinning which can be characterized by several parameters including the proportions of the carbons and hydrogens having different chemical shifts in the NMR analysis. The pitch composition for spinning is then subjected to spinning under specific conditions including the temperature condition for controlling the viscosity behavior of the molten pitch composition determined by use of the Andrade's equation and the pitch filament is then infusibilized in an oxidative atmosphere and carbonized in an inert atmosphere into carbon fibers having a tensile strength of at least 200 kg/mm$^2$ and a tensile modulus of at least 10 tons/mm$^2$.

10 Claims, 4 Drawing Figures

PITCH-BASED CARBON FIBERS AND PITCH COMPOSITIONS AND PRECURSOR FIBERS THEREFOR

BACKGROUND OF THE INVENTION

The present invention relates to high-strength, high-modulus carbon fibers prepared from a pitch composition as the starting material as well as a pitch composition and precursor fibers therefrom for the preparation of the carbon fibers.

More particularly, the invention relates to high-strength, high-modulus carbon fibers prepared from a specific pitch composition by a process involving the steps of hydrotreatment, high temperature heat treatment, melt spinning, infusibilization and carbonization as well as the pitch composition as the starting material and the precursor fibers obtained therefrom.

As is well known, the carbon fibers currently produced and widely used are classified into two according to the starting material, i.e. the so-called PAN (polyacrylonitrile)-based carbon fibers prepared by the carbonization of polyacrylonitrile fibers and the pitch-based carbon fibers prepared from pitches of coal- or petroleum-origin.

Despite the advantages of the pitch-based carbon fibers due to the inexpensiveness, the PAN-based carbon fibers occupy the major current of the industrial high-performance carbon fibers having high mechanical strength and high modulus suitable for reinforcing various composite materials since the tensile strength of the pitch-based carbon fibers being industrially produced is relatively low and limited to 200 kg/mm$^2$ or below.

Accordingly, various attempts have been made to develop high-performance carbon fibers starting from inexpensive pitch compositions. Needless to say, the properties of the starting pitch is one of the most important factors for obtaining high-performance pitch-based carbon fibers and several proposals have been made for the preparation of a pitch composition suitable therefor including:

(a) a method in which a specific condensed polycyclic aromatic compound is subjected to a heat treatment or treatment in hydrogen (see, for example, Japanese Patent Publication Nos. 45-28013 and 49-8634);

(b) a method in which a mesophase pitch is obtained by subjecting a tar or pitch of petroleum origin to a first heat treatment in the presence of a Lewis acid catalyst followed by a second heat treatment after removal of the catalyst (see, for example, Japanese Patent Publication No. 53-7533);

(c) a method in which a mesophase pitch having a desired mesophase content is obtained by the heat treatment of a pitch in an atmosphere of a flowing inert gas or under a reduced pressure (see, for example, Japanese Patent Kokai Nos. 53-86717 and 53-86718); and (d) a method in which an optically isotropic pitch is subjected to a treatment with an organic solvent, e.g. benzene, toluene and heptane, and the insoluble fraction is heated to form neomesophase (see, for example, Japanese Pat. Nos. Kokai 54-160427, 55-58287 and 55-130809).

Unfortunately, the above described methods are not effective enough to give a pitch composition from which high-performance carbon fibers, in particular, in respect of the tensile strength comparable to the PAN-based carbon fibers can be prepared. Therefore, the actual application of carbon fibers prepared from an isotropic pitch is limited to those fields in which no particularly high strength is required for the carbon fibers such as reinforcement in asbestos substitutes. Furthermore, the mesophase pitch produced in some of the above described methods has a problem in the practical manufacturing process due to the extremely high viscosity and poor spinnability thereof giving rise to a difficulty in the process of melt spinning at an economically feasible velocity.

In view of the above described status of the technology for the industrial manufacture of pitch-based carbon fibers, the inventors have continued extensive investigations and previously proposed a method for the preparation of carbon fibers through a specific premesophase pitch which is converted into optically anisotropic mesophase in the course of the carbonization after spinning (see Japanese Pat. No. Kokai 58-18421) followed by the development of a process suitable for the industrial production of such a premesophase pitch.

Further investigations of the inventors have revealed that a very important role is played in the pitch composition for high-performance carbon fibers by the chemical structure and chemical properties of the optically isotropic pitch soluble in quinoline as the starting material for the above mentioned premesophase pitch because the basic structure of the condensed polycyclic aromatic compounds in the pitch is retained as such in the spinning melt deeply influencing the spinnability of the pitch as well as the formation of the internal structures of the fibers in the step of spinning. This discovery has led to a guideline for the completion of the present invention according to which the parameters of particular significance are, for example, the number-average molecular weight of the quinoline-soluble fraction of the pitch, the average molecular weight of the structural units in the quinoline-soluble, optically isotropic pitch, the number of the aromatic rings in the condensed polycyclic structure and the density of the pitch as well as the chemical structure represented by the $^{13}$C-NMR and $^{1}$H-NMR spectra having a specific value of the chemical shifts, the aromaticity index and the H/C ratio in specific ranges.

SUMMARY OF THE INVENTION

Thus, the primary object of the present invention is to provide high-performance pitch-based carbon fibers free from the above described disadvantages in the prior art products and a further object of the present invention is to provide a method for the preparation of such high-performance carbon fibers as well as to provide specific pitch compositions as the starting material thereof and the precursor fibers therefrom.

The inventive pitch composition as the starting material for carbon fibers is characterized in that it is an optically isotropic pitch substantially completely soluble in quinoline and having a density of 1.25 to 1.31 at 20° C., which is mainly composed of condensed polycyclic aromatic compounds having a number of the cendensed aromatic rings in a structural unit in the range from 2 to 6, and having an average molecular weight of the structural units as determined by the mass spectrometry in the range from 200 to 400.

The above defined pitch composition of the invention as such is not suitable for spinning but can be rendered suitable therefor by a suitable treatment. The pitch composition suitable for spinning is characterized in that it contains at least 30% by weight of a quinoline-soluble fraction, of which the average molecular weight is in the range from 700 to 1700, and has a density from 1.29 to 1.40 at 20° C. and an aromaticity index from 0.45 to 0.9.

Further, the precursor fibers formed of the above described pitch composition are characterized by the parameters of the angle of orientation of 30° to 50° as determined by the X-ray diffractometry, crystallite size of 2.5 to 4.0 nm, interlamellar distance of 0.343 to 0.350 nm and the strength of at least 200 kg/mm$^2$ after carbonization at 1500° C.

The pitch-based carbon fibers obtained by carbonizing the above defined precursor fibers are characterized by the angle of orientation of 30° to 50° as determined by the X-ray diffractometry, crystallite size of 1.2 to 8.0 nm and interlamellar distance of 0.34 to 0.36 nm in the micro structure and by the tensile strength of at least 200 kg/mm$^2$ or, sometimes, at least 250 kg/mm$^2$ and tensile modulus of at least 10 tons/mm$^2$ or, sometimes, at least 15 tons/mm$^2$ in the mechanical properties.

DETAILED DESCRIPTION OF THE PREFERRED EMBODIMENTS

Figure 1:
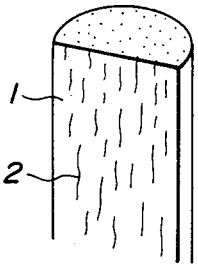
FIG. 1 is a schematic illustration of a perspective view of the pitch filament of the invention showing the cross sections as cut with planes perpendicular to and parallel with the axis.

Generally speaking, a pitch composition as a starting material of high-performance carbon fibers must satisfy simultaneously a molecular mobility to such an extent that orientation of the macromolecules is obtained in the course of spinning and spinnability and flowability of the melt suitable for the formation of filaments by spinning. The prior art technology in this respect has been directed mainly to the molecular orientation and attempts have been made for the preparation of high-performance carbon fibers by the use of so-called mesophase pitches. From the standpoint of the molecular orientation, however, conventional mesophase pitches have been rendered high-polymeric by a heat treatment or other suitable means though with some sacrifice of the spinnability and flowability to cause great difficulties in the process of spinning so that the velocity of spinning can rarely exceed 400 meters/minute even with utmost carefulness of the operators. In addition, the highly developed molecular orientability of the pitch composition tends to prepare coarse leafy domains in the pitch fibers as the precursor of the carbon fibers resulting in the radially developed structure of the final carbon fibers and decreased strength of the fibers due to lengthwise splitting into fibrils, which is one of the reasons for the fact that extensive efforts have been unfruitful in obtaining pitch-based carbon fibers having a tensile strength of 200 kg/mm$^2$ or higher.

Directing their attention to the situation that the internal structure and the performance of the finally obtained carbon fibers largely depend on the chemical structure and properties of the starting pitch composition to be subjected to spinning, the inventors have noted that rather better results can be obtained by decreasing the molecular orientation to some extent in comparison with the conventional mesophase pitches and discovered that, in the course of their investigations for the preparation of a pitch composition suitable for spinning with good balance among the molecular orientation, spinnability and flowability, the basic structural units in the starting pitch never undergo a large alteration in the step of the heat treatment of the starting pitch for the preparation of a pitch composition of increased molecular weight suitable for spinning retaining the basic structure of the pitch before the heat treatment even in the pitch composition for spinning with influences on the finally obtained carbon fibers.

Needless to say, the pitch before the heat treatment has a lower softening point and a larger solubility in organic solvents than the pitch composition prepared for spinning. Therefore, much better efficiency and completeness can be obtained in the removal of the foreign material such as free carbon as another important factor adversely affecting the performance of the carbon fibers from the pitch before the heat treatment than from the pitch composition after the heat treatment.

From the above described standpoint, the primary form of the inventive pitch compositions is an optically isotropic pitch without heat treatment substantially completely soluble in quinoline, in which the chemical structure and the chemical properties are controlled in such a manner that the spinnability of the pitch in the subsequent spinning step is improved contributing to the improvement of the performance of the final carbon fiber products.

According to the results of the investigations undertaken by the inventors, a pitch composition for spinning with somewhat decreased molecular orientation but retaining good balance thereof with the spinnability and flowability is obtained more efficiently by the introduction of a structure hydrogenated to such an extent that the aromaticity is not subject to decrease of a large extent by retaining the basic condensed polycyclic structure of carbon atoms as such. Such a pitch has a chemical structure in which the aromatic nuclei are partially hydrogenated and the planar configuration of the molecules is presumably adequately distorted without destroying the basic skeletal carbon structure. That is to say, the highest efficiency would be obtained by controlling the molecular weight, aromaticity and planiform configuration of the molecules within adequate ranges.

The inventive pitch compositions have been completed on the base of the above described information and the primary form thereof is, first of all, characterized by the substantially complete solubility thereof in quinoline. This characteristic property is important for the efficient removal of the foreign matters such as free carbon. In addition the substantially complete solubility of the pitch means that the pitch is composed of the molecules having relatively uniform molecular weights so that the formation of a uniform pitch composition ready for spinning is greatly facilitated thereby in the subsequent heat treatment.

Further, the inventive pitch composition of the pirmary form is mainly composed of condensed polycyclic aromatic compounds in which the number of the condensed aromatic rings is from 2 to 6 and the average molecular weight of the structural units is in the range from 200 to 400 as determined by the mass spectrometry. These parameters are important in order that the degree of polymerization of the pitch constituents is adequately increased by the heat treatment without difficulty by retaining the flowability. When the values of these parameters are smaller than the lower limits of the above ranges, the pitch constituents have no sufficient polymerizability in the subsequent heat treatment while, when the values of these parameters exceed the upper limits of the above ranges, excessive polymerization takes place in the pitch by the heat treatment to cause loss of flowability in the pitch composition for spinning.

In addition, another limiting parameter of the primary form of the inventive pitch compositions is the density, which should be in the range from 1.25 to 1.31 at 20° C. It should be noted here that the density of the pitch is an indicative parameter for the aromaticity of the pitch. That is, a pitch having a density in the above range has adequately distorted planiform configuration of the molecules with adequately decreased orientability of the molecules while retaining the aromaticity and is capable of imparting flowability to the pitch composition with increased molecular weight by the heat treatment. On the other hand, pitches having a density smaller than 1.25 at 20° C. have unduly low aromaticity and are not free from the problems in the appearance of the planiform configuration or orientation of the molecules in the subsequent step of calcination or carbonization, latent orientability to be imparted in the spinning step and heat stability of the pitch. On the other hand, pitches having a density in excess of 1.31 at 20° C. are undesirable because such a pitch may result in the heat-treated pitch having poor flowability and excessively developed molecular orientation exhibited in the spinning step.

In addition to the above described characteristics, the inventive pitch composition of the primary form is preferably further characterized by the chemical shifts in the NMR spectra such as the $^{13}$C-NMR and $^{1}$H-NMR, aromaticity index and H/C ratio as follows:

(1) In the $^{13}$C-NMR, a preferred pitch composition should contain from 15 to 25% of carbon A, from 55 to 65% of carbon B and from 10 to 20% of carbon C, the carbons A, B and C each having a TMS-based chemical shift of 129 to 150 p.p.m., 80 to 129 p.p.m. and 13 to 53 p.p.m., respectively. This condition is specifically satisfied by the pitch having adequate distortion in the molecular orientation to a preferable extent. In a pitch satisfying the above condition, to say further, (a) adequately distorted planiform structure is prepared in the pitch composition for spinning and the molecular orientability is decreased to a preferable extent, (b) the considerably high aromaticity of the pitch ensures considerably high heat stability so that the condensed polycyclic aromatic structure is retained even after the heat treatment, (c) partial hydrogenation of the aromatic nuclei with enrichment in the content of the active hydrogen is effective for the increase of the molecular weight to a preferable extent in the heat treatment and the spinnability is good due to the good compatibility with the mesophase even in the presence thereof in addition to the high efficiency in the infusibilization treatment owing to the rapid oxidation taking place at the partially hydrogenated positions in the course of the infusibilization treatment, and (d) the pitch composition for spinning formed by the heat treatment regains the planiform molecular configuration in the calcination or carbonization step following the spinning to exhibit good crystallinity and molecular orientation.

(2) In the $^{1}$H-NMR, a preferred pitch composition should contain from 40 to 80% of hydrogen $H_A$ and from 15 to 40% of hydrogen $H_B$, the TMS-based chemical shifts of the hydrogens $H_A$ and $H_B$ being 5 to 10 p.p.m. and 1.7 to 4 p.p.m., respectively. Further, the content of hydrogen $H_C$ having 1.1 to 1.7 p.p.m. of the TMS-based chemical shift should preferably be 5% or less or, more preferably, 3% or less and the content of hydrogen $H_D$ having 0.3 to 1.1 p.p.m. of the TMS-based chemical shift should preferably be 5% or less or, more preferably, 1% or less.

In addition, the contents of the hydrogens $H_E$, $H_F$ and $H_G$ having the TMS-based chemical shifts of 2.6 to 3 p.p.m., 3 to 4 p.p.m. and 1.7 to 2.2 p.p.m., respectively, should preferably be in the ranges of 8 to 11%, 8 to 17% and 5 to 7%, respectively, and further better results can be obtained when, in addition to the above given limitations, the content of the hydrogen $H_H$ having a TMS-based chemical shift of 5 to 7 p.p.m. is in the range from 6 to 15%. This hydrogen $H_H$ presumably originates in the double bonds indicating that the above mentioned aromatic nuclei have been partially hydrogenated.

When the above defined parameters relative to the values determined in the $^{1}$H-NMR are satisfied, the pitch composition has a considerably high aromaticity and can give a pitch composition for spinning with latent molecular orientability and the pitch composition prepared therefrom may retain good flowability notwithstanding the molecular weight adequately increased in the subsequent heat treatment by virtue of the partially hydrogenated structure rich in the active hydrogen while retaining the condensed polycyclic structure. Furthermore, the relatively small content of the side chains leads to the advantages that the polymerization and development of the molecular orientability to excessively high extents can be prevented in the course of the heat treatment.

(3) The aromaticity index should preferably be in the range from 0.3 to 0.5 and the H/C molar ratio should preferably be in the range from 0.55 to 0.8. These parameters in the above ranges mean that the partial hydrogenation of the aromatic nuclei has been performed resulting in a preferable condition.

In the next place, descriptions are given for the methods of determination of the above mentioned parameters, i.e. the average molecular weight of the structural units, aromaticity index, $^{1}$H-NMR, $^{13}$C-NMR and H/C molar ratio.

(1) Average molecular weight of the structual units: mass spectrometry was undertaken for the determination thereof. The equipment used was a mass spectrometer Model JMS-D300 manufactured by Nippon Denshi Co. with EI as the ionization means.

(2) Aromaticity index: the infrared absorption spectrum of the material was taken by the KBr tablet method on a infrared spectrophotometer Model IR-270 manufactured by Shimadzu Works and the value of the aromaticity index was calculated from the following equation.

$$\text{Aromaticity index} = \frac{\left(\begin{matrix}\text{intensity at}\\ 3050\ \text{cm}^{-1}\end{matrix}\right)}{\left(\begin{matrix}\text{intensity at}\\ 3050\ \text{cm}^{-1}\end{matrix}\right) + \left(\begin{matrix}\text{intensity at}\\ 2925\ \text{cm}^{-1}\end{matrix}\right)}$$

(3) $^1$H-NMR: the NMR spectrum of the material was taken in $CDCl_3$ as the solvent and the values of the chemical shifts in $\gamma$ were expressed with TMS as the internal standard. The apparatus was an NMR spectrometer Model PS-100 manufactured by Nippon Denshi Co.

(4) $^{13}$C-NMR: the measurement was conducted under substantially the same conditions as in $^1$H-NMR above with the non-NOE mode of the gated coupling and 7 seconds of the pulse recurring interval.

(5) H/C molar ratio: elementary analysis was undertaken according to the procedure specified in JIS M 8813 and the value of H/C was calculated from the following equation with the contents of the respective elements in % by weight.

$$H/C \text{ ratio} = \frac{(\text{content of } H)}{1} \Big/ \frac{(\text{content of } C)}{12}$$

When heat-treated following removal of the solid foreign matter such as free carbon by filtration, the pitch composition having the above described several characteristic parameters as the first embodiment of the invention is polymerized while the basic structure specific to the polycondensed aromatic compounds is retained.

The heat treatment should be completed when the content of the quinoline-soluble fraction in the pitch composition has reached at least 30% or, preferably, 50 to 70%. The pitch composition having been heat-treated to such a stage has good spinnability. If necessary, the heat treatment is performed under reduced pressure or, alternatively, under atmospheric pressure after removal of the solvent contained in the composition.

The pitch composition as defined above can be prepared by the hydrogenation treatment of a starting pitch after purification by use of a specified hydrogenation solvent. However, it cannot be prepared by a known method involving a mesophase such as the neomesophase and dormant mesophase.

Following is a description of an actual example of the process in which the inventive pitch composition of the primary form is derived from a starting pitch followed by the heat treatment to give a pitch composition for spinning. Suitable starting pitches include coal tars, coal tar pitches, coal-based heavy oils such as liquefied products of coals and petroleum-based heavy oils such as residual oils from distillation of petroleums under reduced or normal pressure as well as the tars and pitches obtained as a byproduct in the heat treatment of these residual oils and oil sands and bitumens. Coal tar pitches are preferred among them because the pitch composition of the invention can be obtained more easily therefrom.

The above defined pitch composition of the invention can be prepared from the above described starting pitch available on the market by purifying and then subjecting it to the first-step treatment by heating in a specific hydrogenation solvent. A pitch composition for spinning can be obtained therefrom subsequently by a second-step high-temperature treatment, if necessary, after removal of or with concurrent removal of the above mentioned solvent.

The most suitable hydrogenation solvent used in the first-step treatment is tetrahydroquinoline (referred to as THQ hereinafter) although a mixture of quinoline and THQ may be used. Equivalent effects can be obtained by the use of quinoline in combination with hydrogen in the presence of a cobalt/molybdenum-based or iron oxide-based catalyst. Alternatively, naphthalene oils, anthracene oils, creosote oils, absorbing oils and the like are also suitable when used in combination with hydrogen. When THQ is used as the hydrogenation solvent, 100 parts by weight of the starting pitch are admixed with 30 to 100 parts by weight of THQ and the mixture is heated at 300° to 500° C. or, preferably, at 340° to 450° C. for 10 to 60 minutes. The product obtained by the first-step treatment in this manner is then subjected to the second-step treatment.

In the second-step treatment, the pitch having been treated with THQ is kept under a reduced pressure of, for example, 50 mmHg or below at a temperature of at least 450° C. or, preferably, from 450° to 550° C. for 5 to 50 minutes. In this case, such a treatment under reduced pressure may be replaced with a heat treatment under atmospheric pressure at a temperature of 450° to 550° C. for 5 to 60 minutes after removal of the THQ. Alternatively, substantially the same effects can be obtained by the removal of the THQ followed by the temperature increase once up to 450° C. or higher and then temperature decrease to 400° to 430° C. where the material is kept for 15 to 180 minutes.

The above described conditions for the first-step treatment should be adequately modified within the limits according to the compositions and properties of the starting pitches so as to impart the pitch composition of the primary form with the above defined values of the parameters.

The pitch composition for spinning obtained by second-step heat treatment of the inventive pitch composition of the primary form as defined above exhibits adequate visco-elastic behavior at the temperature of spinning and is very satisfactory in melt spinning.

The pitch composition ready for melt spinning obtained from the primary form in the above described manner should satisfy the following characterizing parameters: contents of the quinoline-soluble fraction of at least 30% by weight or, preferably, from 50 to 70% by weight; the number-average molecular weight of the quinoline-soluble fraction in the composition of 700 to 1700 or, preferably, 800 to 1500; density at 20° C. of 1.29 to 1.40 or, preferably, 1.30 to 1.35; and aromaticity index of 0.45 to 0.9. The number-average molecular weight of the quinoline-soluble fraction is determined by the method of VPO (vapor pressure osmosis) with pyridine as the solvent and with benzyl as the reference substance in Knauner Dampfdruck Osmometer. The methods for the determination of the other parameters have been described previously.

When the pitch composition for spinning satisfies the above defined characterizing parameters, the pitch composition has good spinnability and the melt spinning thereof can be performed at a high velocity even to exceed 1000 meters/minute. When the content of the quinoline-soluble fraction is smaller than 30% by weight in the pitch composition, for example, the pitch composition has a relatively high softening temperature with poor spinnability and the finally obtained carbon fibers have a radial structure with poor mechanical properties.

As is known, the conventional mesophase pitch is a mixture of quinoline-soluble and quinoline-insoluble fractions and these two types of the constituents are poorly compatible with each other tending to cause phase separation which adversely affects the spinnability of the pitch composition. On the contrary, the pitch composition for spinning prepared according to the invention and imparted with the above defined characterizing parameters is advantageous in the good compatibility of the quinoline-soluble and quinoline-insoluble fractions contained therein so that satisfactory spinnability can be retained even in the compositions containing a considerably large amount of the quinoline-insoluble fraction. In addition, the pitch composition for spinning according to the invention has a structure in which the aromatic nuclei are partially hydrogenated while retaining the high aromaticity of the condensed polycyclic compounds so that the planiform configuration of the condensed polycyclic compounds is adequately distorted to prevent formation of the gigantic leafy domains. Further, the pitch filaments obtained by spinning this pitch composition are imparted with latent molecular orientability and subsequent carbonization treatment thereof regains the planiform configuration along with exhibition of excellent molecular orientation and crystallinity. The excellent flowability of the pitch composition in the melt spinning presumably is a consequence of the increased mobility of the molecules due to the above mentioned distortion in the planiform configuration.

When the number-average molecular weight of the quinoline-soluble constituents in the pitch composition is smaller than 700, on one hand, disadvantages are caused in the possible phase separation between the quinoline-soluble and -insoluble fractions, increased breaking of the pitch filaments obtained by spinning the pitch composition by melt-down in the infusibilization and formation of defects in the carbonization treatment by the falling-off of low molecular weight compounds. When the number-average molecular weight of the quinoline-soluble constituents in the pitch composition exceeds 1700, on the other hand, the softening temperature of the pitch composition may be somewhat too high so that difficulties are encountered in the smooth spinning. The density and the aromaticity index of the pitch composition are also important factors since gigantic leafy domains may sometimes be formed in the finally obtained carbon fibers when prepared from a pitch composition not satisfying these parameters so that no high-performance carbon fibers can be obtained in addition to the problem of decreased flowability of the composition in the melt spinning.

According to the further investigations undertaken by the inventors, better results may be obtained when the pitch composition for spinning has following characteristics in the NMR spectrum and the H/C molar ratio in addition to the above described several parameters.

(a) In the $^1$H-NMR of the quinoline-soluble fraction, the contents of the hydrogens $H_A$ and $H_B$ corresponding to the TMS-based chemical shifts of 5 to 7 p.p.m. and 3 to 4 p.p.m., respectively, should be in the ranges of 4.5 to 10% and 2.5 to 7.5%, respectively, based on the total detectable hydrogens excepting the solvent. This condition means that the aromatic nuclei in the condensed polycyclic compounds are partially hydrogenated and the planiform configuration of the molecules is somewhat distorted.

(b) The H/C molar ratio of the pitch composition should be in the range from 0.5 to 0.65. This condition indicates the above mentioned hydrogenated structure and high aromaticity retained.

The pitch composition for spinning satisfying the above given parameters is composed of the structural units each formed of 4 to 6 aromatic rings integrally condensed to form a polycyclic structure and the aromatic nuclei of each of the structural units are partially hydrogenated with somewhat distorted planiform configuration of the molecules. Such a pitch composition suitable for melt spinning is, as is described before, obtained by the two-step treatment of the inventive pitch composition of the primary form, that is, the first step of the treatment is undertaken in a hydrogenation solvent to partially hydrogenate the aromatic nuclei to give a distorted planiform configuration of the molecules while such a basic structure is retained throughout the second step of heat treatment along with the linkage formation at the side chains to give the pitch composition suitable for spinning.

The melt spinning can be performed according to a process known in itself. For example, pitch filaments are readily obtained when the pitch composition is kept at a temperature higher than the softening point thereof by 50° to 100° C. and extruded through a spinneret having openings of each 0.1 to 0.8 mm diameter and the filaments thus extruded out of the spinneret are taken up on a winding drum at a velocity of 300 to 1500 meters/minute. The pitch filaments are then subjected to an infusibilization treatment by heating for 5 to 30 minutes at 250° to 350° C. following temperature elevation up to the above temperature at a rate of 0.5° to 3° C./minute in the presence of oxygen and then to a carbonization treatment by heating for 10 to 35 minutes at 1000° to 1500° C. in an atomsphere of an inert gas following temperature elevation up to the temperature at a rate of 2° to 5° C./minute.

The carbon fibers obtained from the above defined pitch composition has been converted to a complete mesophase in the course of the above described carbonization treatment and the thus obtained carbon fibers have a dense structure with sufficient molecular orientation but containing no gigantic domains. The carbon fibers are very excellent in the mechanical properties and have a tensile strength of at least 200 kg/mm$^2$ and a tensile modulus of at least 10 tons/mm$^2$ or, in some preferable cases, a tensile strength of at least 250 kg mm$^2$ and a tensile modulus of at least 15 tons/mm$^2$.

The pitch filament, i.e. the filament obtained by spinning the above defined pitch composition for spinning in the above described spinning conditions, is the precursor for the final carbon fibers having a tensile strength of at least 200 kg/mm$^2$ exhibited when the pitch filament is carbonized at 1500° C. and is characterized by several crystallographic data obtained by X-ray diffractometry including the angle of orientation of 30° to 50° C., crystallite size of 2.5 to 4.0 nm and interlamellar distance of 0.343 to 0.350 nm.

To give a description in more detail, it has been generally accepted in the prior art that, when highstrength, high-modulus carbon fibers are to be obtained from a mesophase pitch, the pitch filaments as the precursor immediately after spinning of the pitch should preferably have a high molecular orientation. Although being imparted with high thermal and electric conductivities as the characteristics of the graphitized structure due to the increased crystallite size ($L_c$) in orientation in the direction of the fiber axis, the carbon fibers prepared from such highly oriented precursor pitch filaments have insufficient mechanical properties, e.g. tensile strength and elongation, in comparison with the PAN-based carbon fibers. One of the reasons therefor is presumably that the excessively highly oriented structure to meet the requirement for the graphitized structure results on the contrary in a non-uniform microstructure within the fibers leading to the eventual lengthwise splitting of the fibers and consequent decrease in the mechanical strengths thereof.

As is mentioned above, the pitch filaments as the precursor for the carbon fibers have the X-ray diffractometric structural parameters controlled in adequate ranges so that coarsening of the crystallites in the course of the calcination or carbonization treatment can be prevented and crack formation or splitting of the fibers in the direction of the fiber axis can effectively be prevented.

Specifically, highly oriented pitch filaments with an angle of orientation of smaller than 30° are disadvantageous because the crystallites within the fibers may sometimes take a coarse radial structure in the course of the carbonization or calcination treatment and the resultant carbon fibers are susceptible to crack formation. When the angle of orientation in the pitch filaments exceeds 50°, on the other hand, the re-orientation of the crystallites can no longer take place so that the resultant carbon fibers can hardly be imparted with sufficiently high tensile strength and modulus.

The size of the crystallites, i.e. the apparent thickness ($L_c$) of the microcrystallites, and the interlamellar distance ($d_{002}$) are parameters interrelated to the angle of orientation. For example, decrease in the angle of orientation results in the increase in the crystallite size and decrease in the interlamellar distance. Therefore, good balance is essential among these three structural parameters of the angle of orientation (OA), crystallite size ($L_c$) and interlamellar distance ($d_{002}$) in order to obtain high-strength, high-modulus carbon fibers, which can be obtained only when these parameters are within definite ranges of 30° to 50° or, preferably, 35° to 45° for the angle of orientation (OA), 2.5 to 4.0 nm or, preferably, 2.7 to 3.7 nm for the crystallite size ($L_c$) and 0.343 to 0.350 nm for the interlamellar distance ($d_{002}$).

The here implied angle of orientation (OA), crystallite size ($L_c$) and interlamellar distance ($d_{002}$) are determined by the methods conventionally undertaken by the X-ray diffractometry for fibrous states. That is, a bundle of the carbon fibers is mounted perpendicularly to the direction of the X-ray beams of, for example, the CuK$\alpha$ line and scanning is performed between 0° to 90° of the angle $2\theta$ to determine the overall width (half-value width) B at the half height of the maximum value of the peak in the intensity distribution of the (002) band in the proximity of about 26° for $2\theta$ so that the values of $L_c$ and $d_{002}$ can be calculated from the following equations as a function of the B and $2\theta$.

$$L_c = \frac{K\lambda}{(B - b)\cos\theta},$$

in which K is a constant equal to 0.9, b is 0.0017 radian and $\lambda = 1.5418$ Å, and $$d_{002} = \lambda/2 \sin\theta.$$

Further, the angle of orientation is determined by the half-value width at the point of a half height of the maximum intensity in the intensity distribution of the (002) band by the 180° rotation of the fiber bundle within a plane perpendicular to the direction of the X-ray beams at the position of the angle $2\theta$ at which the intensity distribution of the (002) band is maximum.

In addition to the above described X-ray diffractometric parameters, the pitch filaments as the precursor of the carbon fibers contain at least 30% by weight or, preferably, from 50 to 70% by weight of the quinoline-soluble fraction as in the pitch composition for spinning. When this content is smaller than 30% by weight or, in other words, when the content of the quinoline-insoluble fraction is in excess of 70% by weight, the carbon fibers obtained from the precursor filaments may sometimes have a radial structure.

In particular, almost ideal crystallite size and state of orientation can be obtained in the carbon fibers prepared by carbonizing the pitch filaments containing from 50 to 70% by weight of the quinoline-soluble fraction and having a structure in which optically anisotropic constituents are finely dispersed in a streak-like or fibril-like manner in the matrix of the optically isotropic quinoline-soluble fraction owing to the growth of the crystallites around the nuclei of the finely dispersed optically anisotropic constituents. It is essential that the optically anisotropic constituents are contained not in the form of spherulites but in a state of orientation in the direction of the fiber axis in a strict sense. The anisotropic domain extending in a streak-like or fibril-like form has a width of 1 $\mu$m or smaller and a length of at least 10 $\mu$m.

FIG. 1 is a schematic illustration of the preferable structure of the pitch filament showing a cross section in the axial direction, in which the optically isotropic matrix 1 formed of the quinoline-soluble fraction viewable as a dark ground under cross Nicol prisms contains the streaks or fibrils 2 formed of the optically anisotropic fraction finely dispersed in the matrix 1 and brightening when viewed under cross Nicol prisms.

The optically isotropic, quinoline-soluble fraction forming the matrix of the fiber structure is preferably the pitch of the "premesophase" as previously nominated by the inventors and, in particular, should have a number-average molecular weight of preferably from 700 to 1700 or, more preferably, from 1000 to 1500. The most suitable pitch composition as a whole of which the pitch filaments are formed should have a density of 1.29 to 1.40 or, preferably, 1.30 to 1.35 at 20° C. and be composed of condensed polycyclic aromatic rings with an aromaticity index of 0.45 to 0.9, in addition to the other preferable parameters of the H/C molar ratio and the proportions of the hydrogens $H_A$ and $H_B$ as described before for the pitch composition for spinning.

According to the investigations by the inventors, the pitch composition satisfying the above described requirements has a structure in which the nuclei of the condensed polycyclic compounds are partially hydrogenated to give a distorted planiform configuration of the molecules so that the molecules have sufficiently high mobility notwithstanding the relatively large molecular weight along with the good compatibility of the quinoline-soluble and -insoluble constituents.

Such a pitch composition can readily be infusibilized by the rapid oxidation taking place at the positions of the partial hydrogenation in the course of the infusibilization treatment and the once distorted configuration of the planiform molecules can be dissolved when the hydrogen atoms are eliminated in the course of the infusibilization and carbonization treatments to be converted into the mesophase forming good crystallites.

As is mentioned before, the infusibilization and carbonization treatments of the above characterized pitch filaments give carbon fibers having mechanical properties comparable to or rather better than those of the conventional PAN-based carbon fibers. The essential factors for the exhibition of such excellent mechanical properties are the characteristic parameters of the pitch composition for spinning and the conditions of the process including the spinning of the pitch composition into pitch filaments as well as the subsequent steps of the infusibilization and carbonization of the pitch filaments. The carbon fibers obtained in such a manner are characterized by the microstructure as determined by the X-ray diffractometry including the angle of orientation (OA) of 30° to 50°, the crystallite size ($L_c$) of 1.2 to 8.0 nm and the interlamellar distance ($d_{002}$) of 0.34 to 0.36 nm and have a tensile strength of at least 200 kg/mm$^2$ and a tensile modulus of at least 10 tons/mm$^2$.

The carbon fibers of the high-performance grade prepared from a conventional mesophase pitch composition have a three-dimensional structure of polycrystalline graphite formed of crystallites having a crystallite size $L_c$ larger than 8.0 nm having an angle of orientation OA smaller than 30° and highly oriented in the direction of the fiber axis. Such carbon fibers are inferior to the PAN-based carbon fibers in the mechanical properties or, in particular, in the tensile behavior though exhibiting high thermal and electric conductivities characteristic to the graphitized structure. This is presumably a consequence of the excessively high orientation in view of the importance of the graphitization resulting in the non-uniform microstructure in the fiber structure along with the formation of a radial structure susceptible to crack formation resulting in the exhibition of the greatly decreased macroscopic physical properties.

On the contrary, the pitch-based carbon fibers according to the invention have a very dense crystalline structure with the crystallographic parameters as given above. Further, the inventive carbon fibers contain no gigantic leafy domains extending in the direction of the fiber length as sometimes observed in the conventional carbon fibers prepared from a mesophase pitch and the structure thereof is relatively uniform having extremely high tensile strength and modulus.

Generally speaking, the crystallite size $L_c$ and the interlamellar distance $d_{002}$ are parameters interrelated with the above mentioned angle of orientation. For example, smaller angles of orientation are usually accompanied as a trend by a larger crystallite size and a smaller interlamellar distance. When the crystallite size is too large and the interlamellar distance is too small, the tensile strength of the carbon fibers cannot be sufficiently high while the tensile modulus is decreased when the crystallite size is too small and the interlameller distance is too large.

The carbon fibers of the invention have characteristically good balance of the above mentioned three structural parameters of the angle of orientation, crystallite size and interlameller distance and are thereby imparted with excellent mechanical properties outstandingly different from those of the conventional pitch-based carbon fibers.

In addition to the above specified specific microstructure determined by the X-ray diffractometry, the crystallites in the peripheral layer of the inventive carbon fiber are oriented in the circumferential direction as viewed in the cross section perpendicular to the fiber axis and this condition of the crystallite orientation is advantageous by preventing crack formation in and imparting higher mechanical strengths to the carbon fiber.

Figure 2A:
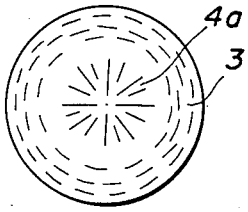
FIGS. 2*a* and 2*b* are each a schematic illustration of the sheath-and-core structure in the cross section of the inventive carbon fiber.
Figure 2B:
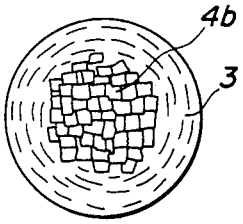

The above mentioned cross sectional structure of the carbon fiber with the circumferentially oriented carbon layers can be observed by means of a scanning-type electron microscope. FIGS. 2*a* and 2*b* are each a schematic illustration of an example of such a circumferentially oriented structure, in which the peripheral layer 3 is composed of the circumferentially oriented crystallites, the crystallites forming layers of carbon each in the form of a curved plate running in parallel to the surface of the fiber, and the core 4*a* or 4*b* is formed of the radial (FIG. 2*a*) or mosaic-wise (FIG. 2*b*) orientation of the crystallites. In this case, the peripheral layer 3 should have a thickness of at least 10% or, preferably, from 10 to 60% of the radius of the fiber cross section since the effect of the peripheral layer 3 to prevent crack formation is decreased with the decrease in the thickness thereof. The structure of the core portion is not particularly limitative when provided with a sufficiently high density. For example, the core portion may have a coaxially oriented structure with the peripheral layer 3 so that no interface can be distinguished between the peripheral layer and the core. It is, however, preferable that the structure of the core is not coaxial with the peripheral layer 3 but is radial or mosaic-like as is illustrated in FIGS. 2*a* and 2*b*, respectively, for the reason that a higher tensile modulus can be obtained with such a binary sheath-and-core structure.

The diameter of each of the inventive carbon fibers is preferably in the range from 5 to 50 μm while the length of the fiber is, of course, not limitative according to need.

The inventive carbon fibers characterized by the above described specific structure have at least 200 kg mm$^2$ of a tensile strength and at least 10 tons/mm$^2$ of a tensile modulus and very useful as a reinforcing material for a synthetic resin-based composite material, in particular, when the carbon fibers have a tensile strength in excess of 250 kg/mm$^2$ and a modulus in excess of 15 tons/mm$^2$.

Following is a summarizing description of the process for the preparation of the above defined inventive carbon fibers, which has been already given in some detail.

The above described high-performance carbon fibers of the present invention can be obtained by melt spinning of a pitch composition for spinning containing a premesophase pitch at the specified temperature conditions into pitch filaments followed by the infusibilization and carbonization treatments thereof.

The premesophase pitch forming at least part of the pitch composition for spinning is clearly distinguished from the so-called dormant mesophase pitch since the former is optically isotropic and convertible into an optically anisotropic mesophase pitch by heating at 600° C. or higher while the latter is imparted with optical anisotropy under external forces.

In addition to the content of the premesophase pitch, the pitch composition for spinning suitable in the invention should satisfy the requirements as have been described in connection with the content of the quinoline-soluble fraction having a specified number-average molecular weight, density, aromaticity index, H/C molar ratio and proportions of the hydrogens $H_A$ and $H_B$ characterized by the results of the proton-NMR.

Such a pitch composition for spinning is obtained from various bituminous materials by the treatments in two steps composed of the first step of the heat treatment in the presence of a specific hydrogenation solvent, e.g. tetrahydroguinoline, and the second step of the heat treatment at a higher temperature following or with simultaneous removing of the solvent.

The thus obtained pitch composition for spinning containing the premesophase pitch is characterized by the specific temperature dependency of the viscosity.

As is known, the temperature-viscosity relationship of a pitch material is expressed by the Andrade's equation $$\eta_a = A \exp(B/T) = A \exp(\Delta H_a/RT) \quad \text{(I)},$$

in which $\eta_a$ is the viscosity of the pitch, A is a constant, $B = \Delta H_a/R$, $\Delta H_a$ is the apparent activation energy for flowing of the pitch, R is the gas constant and T is the absolute temperature in K. Equating the logarisms of both sides of the above equation, $$\log \eta_a = \log A + B/2.303\ T. \quad \text{(II)}$$

Figure 3:
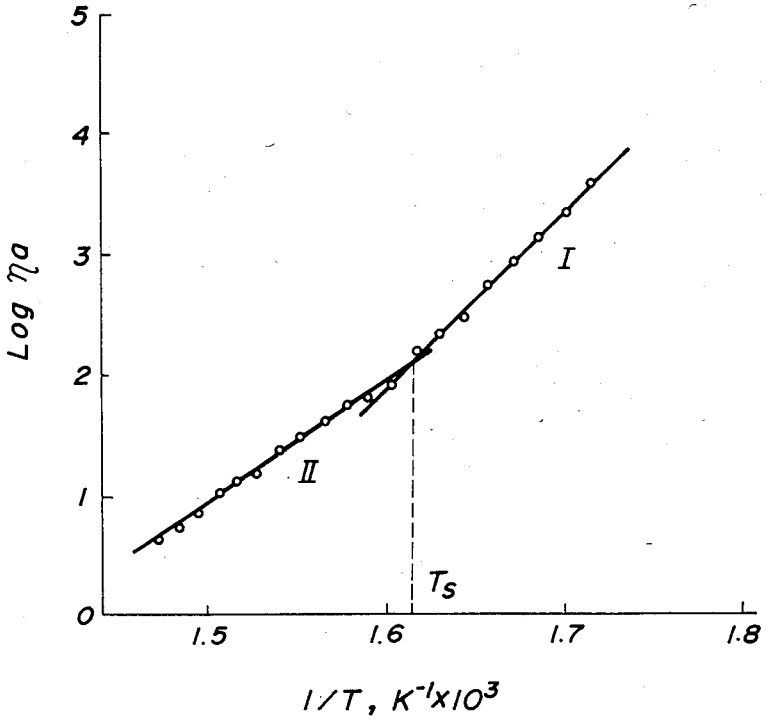
FIG. 3 is a graph showing the relationship between the logarithm of the viscosity of the inventive pitch composition for spinning and the reciprocal of the temperature in K.

Thus, log $\eta_a$ is linearly correlated with 1/T. In terms of this first-order equation, the temperature-viscosity relationship of the pitch composition for spinning suitable for use in the invention does not follow a single straight line but expressed two intersecting straight lines making a definite angle therebetween. In other words, the viscosity behavior of the pitch composition is different between the temperature ranges higher and lower than the temperature corresponding to the intersection of the two straight lines. FIG. 3 is a graphic showing of the viscosity behavior of the pitch composition taking the value of 1/T as the abscissa and the value of log $\eta$ as the ordinate, in which the straight line I in the low temperature region intersects with the straight line II in the high temperature region at a temperature $T_s$.

The examination of the pitch composition with a reflective polarizing microscope indicated that the optical characteristic of the pitch composition changes between the regions below and above the temperature $T_s$ for the intersection of the two straight lines I and II. That is, the optical anisotropy of the pitch composition containing the mesophase pitch disappears when heated above the temperature $T_s$. In the following, the temperature $T_s$ is called the "temperature of viscosity change".

In the preparation of the carbon fibers according to the invention, spinning of the pitch composition must be performed after heating the pitch composition at a temperature above the temperature of viscosity change $T_s$. When spinning of the pitch composition is performed without heating it above this temperature, the crystallite in the resultant fibers are always oriented in a radial structure so that the carbon fibers are subject to the formation of cracks while, on the other hand, heating of the pitch composition above this temperature has an effect that the plate-like layers of carbon are formed beginning at the surface of the fiber and circumferentially oriented in parallel to the surface of the fiber with the radially or mosaic-wise structured core portion. Experiments have indicated that the thickness of the circumferential peripheral layer is increased as the temperature of heating of the pitch composition is increased above the temperature of viscosity change and, eventually, the whole body of the fiber may take a coaxial lamellar structure or the so-called onion structure.

The above mentioned phenomenon of the specific viscosity behavior of the pitch composition takes place not only when spinning of the pitch composition is performed at a temperature higher than $T_s$ but also when the temperature of the pitch composition is increased to a temperature $T_A$ higher than $T_s$ followed by rapid cooling to a temperature $T_B$ lower than $T_s$ at which spinning of the pitch composition is performed. Therefore, it is preferable that, when the viscosity of the pitch composition is too small to ensure smooth spinning at a temperature higher than $T_s$, the pitch composition is first heated to a temperature $T_A$ substantially higher than $T_s$ followed by rapid decrease of the temperature to $T_B$ at which the pitch composition has a viscosity suitable for spinning and spinning of the pitch composition can be performed satisfactorily.

It should be noted further that the filament of the molten pitch composition extruded out of the spinneret should be cooled and solidified as rapidly as possible so that the drafting ratio at the spinning is preferably at least 30 to ensure rapid quenching of the filament. This situation is presumably due to the fact that, at a temperature higher than the $T_s$, the lamellar structure of the mesophase pitch is destroyed by the thermal movement of the molecules and the molecules forming the mesophase pitch are mobile independently from each other so that radial orientation of the mesophase lamellae within the cross section by the shearing force at the spinneret otherwise taking place is greatly disturbed when the molten pitch composition is extruded out of the spinneret retaining the above mentioned mobile condition of the molecules and quenching of the thus extruded pitch filament results in the coaxial structure in the peripheral layer of the filament.

On the other hand, the mobile condition of the molecules is retained when heating of the pitch composition at a temperature above $T_s$ is followed by rapid cooling below $T_s$. Therefore, spinning of the pitch composition can be performed with smoothness, for example, by use of a spinning apparatus having the melting section for the pitch composition and the spinneret provided with independent means for temperature control in which the pitch composition is first heated at a temperature $T_A$ higher than $T_s$ in the melting section and then transferred toward the spinneret where the temperature of the molten pitch composition has been rapidly decreased, preferably, within a few minutes down to a temperature $T_B$ suitable for spinning out of the spinneret.

Although the temperature-viscosity relationship of a pitch composition depends on the type of the starting pitch and the conditions for the preparation of the pitch composition for spinning, the temperature of viscosity change $T_s$ can readily be determined experimentally. Usually, this temperature $T_s$ is correlated with the softening temperature of the pitch composition and the temperature $T_s$ is higher than the softening temperature of the pitch composition by 70° to 90° C. In performing spinning of the pitch composition for spinning according to the invention, the pitch composition is heated preferably at a temperature $T_A$ which is higher than the temperature $T_s$ by 30° to 40° C. This condition of preheating of the pitch composition is preferable when the coaxially oriented structure is desired in at least the very surface layer of the fiber. As is understood, the preheating temperature of a pitch composition for spinning should preferably be higher than the softening temperature of the pitch composition by 100° to 130° C. while an excessively high preheating temperature over the above range is undesirable owing to the formation of the spherulitic mesophase pitch undissolvable even by heating at a still higher temperature in the molten pitch composition.

The temperature decrease of the molten pitch composition from the above mentioned preheating temperature $T_A$ rapidly down to a temperature suitable for spinning is preferable by from about 40° to about 80° C. though dependent on the types of the pitch and the conditions for the preparation of the pitch composition for spinning. The temperature of the pitch composition $T_B$ at which it is extruded out of the spinneret is preferably higher than the softening temperature of the pitch composition by 30° to 80° C. depending on the types of the pitch composition.

The pitch filament extruded out of the spinning nozzle under the above described conditions should be wound up on a drum with at least 30 or, preferably, at least 50 of the drafting ratio which is a value obtained from the velocity of winding up of the filament divided by the linear velocity of the molten pitch composition at the exit of the spinneret. When wound up with the above mentioned drafting ratio following spinning, the molten filament is rapidly cooled and solidified into a pitch filament having a large angle of orientation but adequately controlled growth of the crystallites. The velocity of winding up of the pitch filament is usually in the range from 300 to 1500 meters/minute and a velocity larger than 1000 meters/minute has no particular adverse influences on the very smooth spinning of the pitch composition under the above described conditions for spinning.

The pitch filament obtained in the above described specific spinning conditions is then subjected to the infusibilization treatment in the presence of oxygen by elevating the temperature at a rate of 0.5° to 3° C. per minute up to 250° to 350° C. followed by keeping at this temperature for 5 to 30 minutes. As is mentioned before, this infusibilization treatment can be completed within a short time when the pitch composition used for spinning has been mainly composed of the condensed polycyclic compounds having partially hydrogenated aromatic nuclei in comparison with the pitch filaments formed of a conventional pitch composition. This is presumably because the oxygen atoms are readily introducible into the positions where the aromatic nuclei have been partially hydrogenated to give the condensed polycyclic compounds.

The thus infusibilized filaments are then converted into the final carbon fiber product by carbonization in an inert atmosphere, usually, at a temperature of 1000° to 500° C. for 10 to 30 minutes following temperature elevation at a rate of 2° to 15° C./minute up to the above mentioned carbonization temperature.

It is noted that the crystallite size $L_c$ in the carbon fibers prepared in the above described manner depends on the temperature of carbonization and increases with the increase in this temperature. A temperature of carbonization higher than 1500° C. usually results in a too large crystallite size although carbonization can be performed at such a high temperature provided that the crystallite size does not exceed 8 nm by virtue of the otherwise favorable conditions.

The thus obtained carbon fibers may be used either as such or, optionally, after graphitization by heating at about 3000° C.

Following are the examples and comparative examples to illustrate the present invention in more detail. In the following, the viscosity of the molten pitch composition, softening temperature of the pitch composition and mechanical properties of the carbon fibers were determined according to the procedures give below. The methods for the determination of the other characteristic parameters have already been described and not repeated here.

(1) The apparent viscosity in some of the Examples was determined with a Koka-type flow tester from the descending distance of the plunger using the following equation:

$$(\text{apparent viscosity}) = (\pi R^4/8L)\,(P/Q),$$

in which R is the radius of the nozzle in cm, L is the rand length of the nozzle in cm, P is the load in kg/cm$^2$ and Q is the extruded volume per unit time in cm$^3$/second, the cylinder having a cross section of 1 cm$^2$ and the nozzle having each 0.3 mm of the diameter and rand length.

(2) The viscosity in some of the Examples was determined by use of a double-cylinder rotation viscometer manufactured by Iwamoto Manufacturing Works.

(3) The softening temperature of the pitch composition was determined by use of an apparatus (Model DSC-1D, manufactured by Perkin Elmer Co.). The aluminum-made cell having an inner diameter of 5 mm was charged with 10 mg of a finely pulverized powder of the pitch composition which was heated under gentle compression up to a temperature of about 400° C. at a rate of temperature elevation of 10° C./minute and the softening temperature was taken as the temperature at the inflection point toward the endothermic peak indicating the melting point in the diagram obtained on the apparatus.

(4) Mechanical properties, i.e. tensile strength, elongation and modulus, were determined according to the procedures specified in JIS R-7601 for the "Testing methods for carbon fibers". The diameter of the filament or fiber was determined by use of a laser beam.

EXAMPLE 1

Into a stainless steel-made autoclave of 1 liter capacity equipped with a stirrer rotatable by electromagnetic induction were introduced 134 g of commercially available coal tar-based pitch and 402 g of THQ and, after complete replacement of the air inside with nitrogen, the autoclave was closed with the inside pressure equal to atmospheric. The mixture in the autoclave was heated with agitation up to a temperature of 430° C. and kept at this temperature for 15 minutes. After cooling to room temperature with the stirrer turned off, the mixture was taken out of the autoclave and filtered through a #4 filter paper for qualitative analysis under suction with a water-jet aspirator to remove insoluble matter. The thus obtained filtrate solution was subjected to distillation at 290° C. under a pressure of 10 Torr to remove the solvents mainly composed of the unreacted THQ and quinoline formed by the reaction to leave a pitch composition as the residue suitable for use as a starting material for carbon fibers.

A portion of the above obtained primary pitch composition was taken and subjected to the examination of the characteristics by the mass spectrometry (MS), determination of density at 20° C., measurements of NMR spectra for $^{13}$C-NMR and $^{1}$H-NMR, infrared spectroscopy (IR) and elementary analysis. The remainder of the pitch composition was further subjected to a heat treatment at 465° C. for 15 minutes in an atmosphere of nitrogen gas under a pressure of 10 Torr. The thus obtained pitch composition was suitable for spinning and subjected to spinning, infusibilization treatment and carbonization to give carbon fibers to be evaluated for the characteristic properties.

The results of the above mentioned measurements were as follows. The average molecular weight of the structural units in the primary pitch composition was 230 as determined by the mass spectrometry indicating that the number of the aromatic rings in the condensed polycyclic structure was presumably 4 to 5. The density of the primary pitch composition measured in water as the medium was 1.257 and smaller than the density 1.284 of the commercially available coal tar-based pitch indicating the decrease in the aromaticity, which was examined in further detail by means of the $^{13}$C-NMR, $^{1}$H-NMR, IR and elementary analysis.

Measurement of the $^{13}$C-NMR by use of $CDCl_3$ as the solvent with the non-NOE mode of the gated coupling and 7 seconds of the pulse recurring time interval (hereinafter referred to as the gated mode II) gave a result that the proportions of the carbons A, B and C appearing with the tetramethylsilane(TMS)-based chemical shifts of 129 to 150 p.p.m., 80 to 129 p.p.m. and 13 to 53 p.p.m., respectively, were $C_A$=20.5%; $C_B$=58.5% and $C_C$=17.6%, respectively, based on the total detectable carbon excepting the solvent. By making comparison between this result and the corresponding values of $C_A$=35.8%; $C_B$=55.3% and $C_C$=8.0% for the commercially available coal tar-based pitch, it was understood that the treatment in THQ had effects to decrease the quaternary aromatic carbon and to increase the aliphatic carbon while the total amount of the tertiary aromatic carbon and the olefinic carbon was almost unchanged.

Further, the measurement of the $^{1}$H-NMR by use of $CDCl_3$ gave a result of the proportions of $H_A$=63.1%, $H_B$=31.1%, $H_C$=3.5%; $H_D$=0.9%; $H_E$=9.2%; $H_F$=12.8%; $H_G$=5.8% and $H_H$=11.2%. When this result was compared with the corresponding values of the commercially available coal tar-based pitch of $H_A$=88.5%; $H_B$=9.6%; $H_C$=1.6%; $H_D$=0%; $H_E$=3.7%; $H_F$=2.7%; $H_G$=0.8% and $H_H$=1.9%, it was indicated that the proportions of $H_B$, $H_G$, $H_E$ and $H_F$ corresponding to various kinds of the naphthenic hydrogens and $H_H$ corresponding to the olefinic hydrogens increased to a great extent while the increase in the proportions of $H_C$ and $H_D$ corresponding to the side-chain hydrogens was relatively small. In other words, these data give an indication of the specific structure in the thus treated pitch composition formed by the partial hydrogenation of the aromatic rings while retaining the condensed polycyclic skeleton of the commercially available coal tar-based pitch. Presumably, the above mentioned specific structure causes distortion in the planinform configuration of the molecules with enhancement of the mobility of the pitch molecules while the distortion can readily be dissolved by the dehydrogenation taking place in the course of the carbonization or calcination.

The infrared spectroscopy by the KBr tablet method and the elementary analysis gave the values of the aromaticity index and the H/C molar ratio of 0.43 and 0.70, respectively. These values of the aromaticity index and the H/C molar ratio indicate the effective hydrogenation and the possibility of ready restoration of the planiform configuration in the course of the carbonization taking place in the pitch composition with a still retained high aromaticity for a hydrogenated pitch material.

As is mentioned above, the primary pitch composition was subjected to a heat treatment at 465° C. for 15 minutes with agitation in an atmosphere of nitrogen under a pressure of 10 Torr to give a pitch composition suitable for spinning into carbon fibers, which was melted at 330° C. into a uniform liquid having a viscosity of about 1000 poise.

This pitch composition for spinning contained 58.0% by weight of the quinoline-soluble fraction as determined by the procedure specified in JIS K-2425 and the number-average molecular weight of the quinoline-soluble fraction was 950 as determined by the VPO method with pyridine as the solvent. The density of this pitch composition was 1.322 at 20° C. and the aromaticity index thereof calculated from the infrared absorption spectrum obtained by the KBr tablet method was 0.60. The proportions of the hydrogens $H_A$ and $H_B$ calculated from the results of $^{1}$H-NMR of the quinoline-soluble fraction by use of deuterated pyridine as the solvent were 6.2% and 5.8%, respectively. The H/C molar ratio of this pitch composition was 0.54 as calculated from the results of the elementary analysis undertaken according to JIS M-8813. These data indicate effective introduction of hydrogen into and the adequately distorted planiform molecular configuration in this pitch composition while retaining the highly developed condensed polycyclic skeleton and the aromaticity. It seemed that these characteristic results of the analyses were reflected by the excellent flowing characteristic of the pitch composition, formation of the at least preliminary state for the molecular orientation in the course of spinning and prevention of the gigantic leafy domains eventually leading to the lengthwise splitting of the filaments in the course of carbonization. Meanwhile, the distortion of the planiform molecular configuration in the pitch composition can readily be dissolved by the dehydrogenation taking place in the course of the carbonization treatment.

The above prepared pitch composition for spinning was put into a cylinder having a plunger descending at a constant rate and, after complete elimination of bubbles, extruded at 370° C. to give pitch filaments with winding up at a velocity of 1000 meters/minute. The pitch filaments were converted to infusible fibers by heating in an air stream with temperature elevation from 200° C. to 300° C. at a rate of 2° C./minute followed by keeping at 300° C. for 15 minutes and the thus infusibilized fibers were subjected to a carbonization treatment at 1500° C. for 15 minutes in a stream of nitrogen to give carbon fibers. The thus obtained carbon fibers had a filament diameter of 8.5 to 10 μm, tensile strength of 235 to 245 kg mm$^2$, tensile modulus of 16 to 17 tons mm$^2$ and elongation at break of about 1.5%.

The above obtained carbon fibers were much better in the tensile properties than the comparative carbon fibers prepared directly from the commercially available coal tar pitch in the same manner of the treatment having a tensile strength of 75 kg/mm$^2$ and a tensile modulus of 4 tons/mm$^2$.

Comparative Example 1

Into a three-necked glass flask were introduced 100 g of the same coal tar-based pitch as used in Example 1 and the pitch was heated at 400° C. for 10 hours in a stream of nitrogen under atmospheric pressure. The thus heat-treated pitch was dissolved in 65 ml of dehydrated ethylenediamine and reduced with metallic lithium in an amount equal to the pitch at 80° to 90° C. followed by neutralization in a conventional manner and repetition of washing with water and filtration to give a hydrogenated pitch.

The density of this hydrogenated pitch was 1.147 at 20° C. indicating remarkable decrease by the hydrogenation treatment. The aromaticity index was also remarkably decreased to 0.17 and the H/C molar ratio was 0.99. The proportions of the carbons $C_A$ to $C_C$ and the hydrogens $H_A$ to $H_H$ as calculated from the results of the $^{13}$C-NMR and $^1$H-NMR were: $C_A$=5.8%; $C_B$=13.3% and $C_C$=77.8%; and $H_A$=15.8%; $H_B$=46.8% $H_C$=19.7%; $H_D$=11.7%; $H_E$=10.7%; $H_F$=11.0%; $H_G$=17.4% and $H_H$=7.6%. These data indicated that the condensed polycyclic aromatic skeleton had beeh destroyed to a considerable extent and the hydrogenation of the aromatic rings was not interrupted at an intermediate stage of partial hydrogenation but had proceeded to the complete hydrogenation. Once such a molecular structure of the pitch had been reached, the planiform molecular configuration can hardly be restored by a mere dehydrogenation to leave thermal instability so that it is presumable that breaking of the molecular chains to form low molecular compounds may sometimes take place by the heat in the preparation of the pitch composition for spinning as well as in the infusibilization treatment and carbonization of the pitch filaments into carbon fibers resulting in the increase in the defects of the resultant carbon fibers.

In the next place, the above prepared hydrogenated pitch was heated at 400° C. for 1 hour with agitation in a stream of nitrogen under atmospheric pressure to give a pitch composition suitable for spinning. This pitch composition for spinning contained 99% of the quinoline-soluble fraction and the number-average molecular weight of the quinoline-soluble constituents was 1300 as determined by the VPO method with pyridine as the solvent. The pitch composition had a density of 1.280 at 20° C. and an aromaticity index of 0.43. The proportions of the hydrogens $H_A$ and $H_B$ in the quinoline-soluble fraction were 3.7% and 11.2%, respectively, as calculated from the $^1$H-NMR determined with deuterated pyridine as the solvent and the proportions of the $\beta$- and $\gamma$-hydrogens were 18.3% and 10.5%, respectively, and found to be considerably large. The molar ratio of H/C in this pitch composition was 0.75.

The above described data indicated that the pitch composition was composed of highly developed condensed polycyclic aromatic compounds while side chains were also contained in a considerably large amount. Meanwhile, good planiform molecular configuration was presumably retained in the pitch composition. It is presumable that carbonization of such a pitch composition may cause breaking and falling off of the side chains to some extent leading to the disadvantage of increased defects in the resultant carbon fibers.

The carbon fibers obtained from the above described pitch composition for spinning in the same manner as in Example 1 had a filament diameter of 9 to 9.5 $\mu$m, tensile strength of 148 to 150 kg/mm$^2$ and tensile modulus of 10 tons/mm$^2$.

Comparative Example 2

Into a glass-made three-necked flask equipped with a stirrer were taken 40 g of a commercially available petroleum pitch (a product by Ashland Co.) and the pitch was heated at 430° C. for 5.5 hours in a stream of nitrogen under atmospheric pressure. The thus heat-treated pitch was admixed with 65 ml of dehydrated ethylene diamine and reduced with an equal amount of metallic lithium at 80° to 90° C. followed by neutralization in a conventional manner and repeated washing with water and filtration to give a hydrogenated pitch composition.

A portion of this hydrogenated pitch composition was subjected to the analysis of various characteristic properties in the same manner as in Example 1 to give the results as follows.

The density of the hydrogenated pitch composition was 1.10 at 20° C. showing a considerable decrease. The aromaticity index had greatly decreased to 0.01 and the molar ratio of H/C was 1.14. The proportions of the carbons A to C and the hydrogens A to H as determined from the $^{13}$C-NMR and $^1$H-NMR were: $C_A$=5.3%; $C_B$=12.7% and $C_C$=78.9% and $H_A$=13.6%; $H_B$=45.5%; $H_C$=22.6%; $H_D$=13.4%; $H_E$=9.7%; $H_F$=9.1%; $H_G$=18.5% and $H_H$=4.2%. These results indicated that the condensed polycyclic skeleton had been destroyed to a considerable extent and the degree of hydrogenation of the aromatic rings was not at an intermediate stage but at the complete hydrogenation.

The pitch composition having such a structure has a distorted planiform molecular configuration hardly restorable by a mere dehydrogenation and is thermally unstable so that it may be subject to the breaking of the molecular chains and formation of low molecular compounds by the heat in the course of the preparation of the pitch composition for spinning as well as in the infusibilization and carbonization treatments leading to a possible danger of increased defects in the resultant carbon fibers.

The above prepared hydrogenated pitch composition was further heat-treated at 400° C. for 1 hour with agitation in a stream of nitrogen under atmospheric pressure to give a pitch composition for spinning which was processed into carbon fibers in the same manner as in Example 1. The carbon fibers had a filament diameter of 9 $\mu$m, tensile strength of 140 kg/mm$^2$ and tensile modulus of 10.5 tons/mm$^2$.

Comparative Example 3

The same petroleum pitch as used in Comparative Example 2 was taken in a glass-made three-necked flask equipped with a stirrer and heat-treated at 400° C. for 1 hour in a stream of nitrogen under atmospheric pressure. The thus heat-treated pitch was pulverized and admixed with equal amount of tetrahydrofuran followed by agitation for 1 hour at room temperature in a stream of nitrogen. This mixture was then filtrated with a filter paper and a muslin cloth in a filtering apparatus pressurized with nitrogen to remove insoluble matters. The filtrate was admixed with toluene in a volume of 4 times of the tetrahydrofuran in a nitrogen stream with agitation and agitation was further continued for additional 1 hour. The pitch precipitated in the mixture was collected by filtering through a #4 glass filter followed by drying in a conventional manner. A portion of the thus obtained pitch after fractionation with the solvent was analyzed in the same manner as in Example 1 to give the results as follows.

The thus fractionated pitch had a density of 1.289 at 20° C. and the aromaticity index and the H/C molar ratio were 0.46 and 0.64, respectively. The results of the $^{13}$C-NMR and $^{1}$H-NMR gave the proportions of: $C_A$=15.7%; $C_B$=42.3% and $C_C$=40.7% and $H_A$=56.5%; $H_B$=35.9%; $H_C$=4.1%; $H_D$=1.7%; $H_E$=13.4%; $H_F$=4.7%; $H_G$=5.0% and $H_H$=3.0%. These data indicated that the pitch composition was composed of highly developed condensed aromatic polycyclic rings with good planiform configuration of the molecules. The pitch composition having such a structure may possibly give a highly developed mesophase pitch in the course of the heat treatment for the preparation of the pitch composition for spinning to cause a high possibility of the formation of the gigantic leafy domains in the carbon fibers leading to the lengthwise splitting of the fibers.

The above obtained solvent-fractionated pitch composition was subjected to a heat treatment at 440° C. for 15 minutes with agitation in a stream of nitrogen under atmospheric pressure to give a pitch composition for spinning which was further processed into carbon fibers in the same manner as in Example 1. It was found that the carbon fibers were splitted in the longitudinal direction and the mechanical strengths were varied widely in the ranges of 150 to 100 kg/mm$^2$ of the tensile strength and 8 to 15 tons mm$^2$ of the tensile modulus.

Comparative Example 4

The same coal tar-based pitch as used in Example 1 was heat-treated at 400° C. for 1 hour in a stream of nitrogen under atmospheric pressure and then fractionated with a solvent in the same manner as in Comparative Example 3 to give a solvent-fractionated pitch composition, a portion of which was subjected to the analysis of the characteristic parameters to give the results as follows.

The above obtained solvent-fractionated pitch composition had a density of 1.355 at 20° C. and the aromaticity index and the H/C molar ratio thereof were 0.71 and 0.55, respectively, indicating a very high aromaticity. The proportions of the carbons $C_A$ to $C_C$ and the hydrogens $H_A$ to $H_H$ calculated from the results of the $^{13}$C-NMR and $^{1}$H-NMR were: $C_A$=31.6%; $C_B$=57.7% and $C_C$=8.8% and $H_A$=76.0%; $H_B$=17.5%; $H_C$=3.3%; $H_D$=3.4%; $H_E$=4.8%; $H_F$=3.8%; $H_G$=0.6% and $H_H$=1.0%. These data indicated that the pitch composition had a well developed condensed polycyclic skeleton and was composed almost exclusively of the aromatic rings. The pitch composition having such a structure, presumably, already has a good planiform molecular configuration and may give a highly devleloped mesophase in the course of the heat treatment for the preparation of the pitch composition for spinning which results in the formation of the gigantic leafy domains in the carbon fibers to cause lengthwise splitting of the fibers.

The solvent-fractionated pitch composition was heat-treated at 450° C. for 10 minutes in a stream of nitrogen under atmospheric pressure to give a pitch composition for spinning which was processed into carbon fibers in the same manner as in Example 1. It was found that the carbon fibers were splitted in the longitudinal direction and the mechanical strengths were varied widely in the ranges of 150 to 100 kg/mm$^2$ of the tensile strength and 8 to 12 tons mm$^2$ of the tensile modulus.

Comparative Example 5

The same coal tar-based pitch as used in Example 1 was dissolved in quinoline and the insoluble foreign matter and highly developed carbides in the pitch were removed by filtering the solution. The quinoline in the solution was distilled off to leave the quinoline-soluble fraction in the starting pitch, a portion of which was subjected to the analysis of the characteristic parameters in the same manner as in Example 1 to give the results shown below.

The above obtained quinoline-soluble fraction had a density of 1.341 at 20° C. and the aromaticity index and the H/C molar ratio therof were 0.66 and 0.55, respectively, indicating a high aromaticity. The proportions of the carbons $C_A$ to $C_C$ and the hydrogens $H_A$ to $H_H$ in the pitch composition as calculated from the results of the $^{13}$C-NMR and $^{1}$H-NMR were: $C_A$=35.8%; $C_B$=55.3% and $C_C$=8.0% and $H_A$=88.5%; $H_B$=9.6%; $H_C$ 1.6%; $H_D$=0%; $H_E$=3.7%; $H_F$=2.7%; $H_G$=0.8% and $H_H$=1.9%. These data indicated that the pitch composition had well developed condensed polycyclic rings and almost all of the condensed rings were aromatic rings. The pitch composition having such a structure, presumably, already has a good planiform molecular configuration and may give a highly developed mesophase in the course of the heat treatment for the preparation of a pitch composition for spinning which results in the formation of the gigantic leafy domains in the carbon fibers to cause lengthwise splitting of the fibers.

The quinoline-soluble fraction was further heat-treated at 420° C. for 420 minutes with agitation in a stream of nitrogen under atmospheric pressure to give a pitch composition for spinning. This pitch composition for spinning was very easily separated into a high viscosity portion of the mesophase and a low viscosity portion mainly composed of the non-mesophase so that it could be processed into pitch filaments in the same manner as in Example 1 with extreme difficulties. The pitch filaments barely obtained from the pitch composition in a small amount were subjected to the infusibilization and carbonization treatments into carbon fibers in which lengthwise splitting was found. The mechanical strengths of the thus prepared carbon fibers were varied widely in the ranges of 80 to 140 kg/mm$^2$ of the tensile strength and 7 to 15 tons/mm$^2$ of the tensile modulus.

Comparative Example 6

A petroleum-based pitch composition obtained from a FCC decant oil was analyzed for the determination of the characteristic parameters in the same manner as in Example 1 to give the results give below.

The pitch composition had a density of 1.241 at 20° C. and the aromaticity index and the H/C molar ratio thereof were 0.37 and 0.72, respectively. Although the aromaticity index and the H/C molar ratio were close to those of the pitch composition according to the invention, the considerably smaller density than that of the inventive pitch composition indicated the presence of the well developed side chains substituting on the condensed polycyclic rings. The proportions of the carbons $C_A$ to $C_C$ and the hydrogens $H_A$ to $H_H$ as calculated from the results of the $^{13}$C-NMR and $^{1}$H-NMR were: $C_A$=14.6%; $C_B$=41.1% and $C_C$=43.3% and $H_A$=54.8%; $H_B$=35.6%; $H_C$=4.6%; $H_D$=1.8%; $H_E$=13.2%; $H_F$=6.4%; $H_G$=3.7% and $H_H$=2.3%.

These data indicate well developed condensed polycyclic rings along with well developed short side chains substituting thereon. Further, these data are suggestive of the substantially good planiform configuration of the molecules.

When the pitch composition having such a structure is subjected to the heat treatment for the preparation of a pitch composition for spinning, the thermally unstable side chains may undergo scission which triggers the formation of the highly developed mesophase pitch so that various drawbacks are caused such as the lengthwise splitting of the carbon fibers along with the phase separation in and insufficient spinnability of the pitch composition for spinning due to the deficiency in the compatibility between the mesophase pitch and the low molecular constituents.

The petroleum-based pitch was subjected to the heat treatment at 400° C. for 1000 minutes with agitation in a stream of nitrogen under atmospheric pressure to give a pitch composition for spinning but extreme difficulties were encountered in the spinning of this pitch composition into pitch filaments in the same manner as in Example 1 because phase separation readily took place in the pitch composition into a high viscosity portion composed of the mesophase pitch and a low viscosity portion mainly composed of the non-mesophase pitch. The pitch filaments barely obtained from the pitch composition in a small amount at a winding up velocity decreased to 300 meters/minute were subjected to the infusibilization and carbonization treatments into carbon fibers, which were not free from lengthwise splitting and had widely varied mechanical properties of 80 to 145 kg/mm$^2$ of the tensile strength and 7 to 14 tons/mm$^2$ of the tensile modulus.

Comparative Example 7

One hundred grams of the same coal tar-based pitch as used in Example 1 were heated at 400° C. for 24 hours with agitation in a stream of nitrogen under atmospheric pressure and then reduced with the same amount of metallic lithium at 80° to 90° C. in 65 ml of dehydrated ethylene diamine followed by neutralization in a conventional manner and repeated washing with water and filtration to give a hydrated coal tar pitch. This hydrogenated pitch was further heated at 400° C. for 1 hour with agitation in a stream of nitrogen under atmospheric pressure to give a pitch composition for spinning, a portion of which was subjected to the analysis for the determination of the characteristic parameters in the same manner as in Example 1 to give the results as follows.

Thus, the pitch composition for spinning contained 99% by weight of the quinoline-soluble fraction having a number-average molecular weight of 1300 as determined by the VPO method with pyridine as the solvent. The pitch composition for spinning had a density of 1.280 at 20° C. and the aromaticity index thereof was 0.43. The H/C molar ratio of the quinoline-soluble fraction was 0.75 and the proportions of the hydrogens $H_A$ and $H_B$ thereof calculated from the results of the $^1$H-NMR measured by use of deuterated pyridine as the solvent were 3.7% and 11.2%, respectively, along with the considerably large contents of 18.3% and 10.5% for the $\beta$- and $\gamma$-hydrogens, respectively.

These data indicated that the pitch composition was composed of highly developed condensed polycyclic aromatic compounds though containing a large amount of side chains. The molecules presumably had good planiform configuration. The side chains in such a pitch composition may readily undergo scission to fall off when subjected to the carbonization treatment resulting in increased defects in the resultant carbon fibers. Indeed, the carbon fibers having a diameter of 9.5 $\mu$m prepared from the pitch composition for spinning had a tensile strength of only 148 kg/mm$^2$ and a modulus of 10 tons mm$^2$.

Comparative Example 8

A petroleum-based pitch obtained from a FCC decant oil was heat-treated at 400° C. for 1 hour with agitation in a stream of nitrogen under atmospheric pressure followed by pulverization and the powdered pitch was dispersed in an equal amount of tetrahydrofuran and agitated at room temperature for 1 hour in a stream of nitrogen. The mixture was then filtered through a filter paper and a muslin cloth in a pressurizable filtering apparatus under nitrogen pressure to remove the insoluble matter. The filtrate solution was diluted by adding toluene in 4 times of the tetrahydrofuran by volume with agitation in a stream of nitrogen followed by agitation for additional 1 hour. The precipitates formed in the solution were collected by filtering through a glass filter and dried in a conventional manner. The thus solvent-fractionated pitch was heat-treated at 440° C. for 15 minutes with agitation in a stream of nitrogen under atmospheric pressure to give a pitch composition for spinning, a portion of which was subjected to the analysis for the determination of the characteristic parameters in the same manner as in Example 1 to give the results as follows.

Thus, the pitch composition for spinning contained 50% by weight of quinoline-soluble fraction having a number-average molecular weight of 650 as determined by the VPO method with pyridine as the solvent. The pitch composition had a density of 1.309 at 20° C. and the aromaticity index thereof was 0.51. The H/C molar ratio of the quinoline-soluble fraction was 0.61 and the proportions of the hydrogens $H_A$ and $H_B$ therein calculated from the results of the $^1$H-NMR measured with deuterated pyridine as the solvent were 4.1% and 7.6%, respectively.

These data indicated that the pitch composition was composed of highly developed condensed polycyclic aromatic compounds with excellent planiform molecular configuration. It is presumable that such a pitch composition readily prepares for the formation of gigantic leafy domains in the carbon fibers prepared therefrom due to the presence of the highly developed mesophase pitch so that splitting may sometimes take place in the carbon fibers prepared therefrom.

The carbon fibers having a fiber diameter of 9.8 $\mu$m prepared from the above obtained pitch composition for spinning had a tensile strength of 100 to 150 kg/mm$^2$ and a modulus of 8 to 15 tons mm$^2$ and lengthwise splitting was found in some of the fibers.

Comparative Example 9

The same petroleum-based pitch as used in the preceding Comparative Example was heat-treated at 400° C. for 24 hours with agitation and bubbling of nitrogen gas thereinto under atmospheric pressure to give a pitch composition for spinning, a portion of which was subjected to the analysis of the characteristic parameters in the same manner as in Example 1 to give the results shown below.

Thus, the pitch composition contained 38% by weight of quinoline-soluble fraction having a number-average molecular weight of 600 as determined by the VPO method with pyridine as the solvent. The pitch composition had a density of 1.34 at 20° C. and the aromaticity index thereof was 0.65. The H/C molar ratio of the quinoline-soluble fraction was 0.51 and the proportions of the hydrogens $H_A$ and $H_B$ therein were 1.8% and 3.4%, respectively, as calculated from the results of the $^1$H-NMR measured with deuterated pyridine as the solvent.

These data indicated that the pitch composition was composed of highly developed condensed polycyclic aromatic compounds with excellent planiform molecular configuration. It is presumable that such a pitch composition readily prepares for the formation of gigantic leafy domains in the carbon fibers prepared therefrom due to the presence of the highly developed mesophase pitch so that splitting may sometimes take place in the carbon fibers prepared therefrom.

The attempt of spinning with the above pitch composition for spinning in the same manner as in Example 1 was unsuccessful when the winding up velocity was 600 meters/minute or larger due to the poor spinnability of the pitch composition. It was found that spinning with the pitch composition was barely possible when the winding up velocity was decreased to 300 meters/minute. Accordingly, carbon fibers were prepared therefrom by controlling the descending velocity of the plunger in order to maintain the fiber diameter otherwise in the same manner as in Example 1. The thus obtained carbon fibers having a fiber diameter of 10.3 μm had widely varied mechanical properties of 80 to 145 kg/mm$^2$ of the tensile strength and 7 to 14 tons/mm$^2$ of the modulus with lengthwise splitting in some of the fibers.

EXAMPLE 2

The hydrogenation treatment of the same coal tar-based pitch as in Example 1 was undertaken in just the same manner as in Example 1 followed by the removal of the unreacted THQ and the quinoline formed by the reaction to give a primary pitch composition which was further heated at 465° C. for 15 minutes in an atmosphere of nitrogen under a reduced pressure of 10 mmHg to give a pitch composition for spinning.

This pitch composition had a density of 1.323 at 20° C. and contained 40.3% by weight of quinoline-insoluble fraction and 84.9% by weight of toluence-insoluble fraction. The apparent melt viscosity of the pitch composition was 1430 poise at 320° C. as determined by the method of extrusion through a nozzle under pressure. The number-average molecular weight of the quinoline-soluble fraction was 980 and the density thereof was 1.308 at 20° C. The aromaticity index of the pitch composition was 0.53.

Spinning of the above prepared pitch composition was performed in the manner described below. Thus, the pitch composition was heated at 360° C. in a cylinder for extrusion provided with a filter plate of 1600 mesh opening and a spinneret having a single nozzle of L/D=0.1 (mm)/0.1 (mm) and extruded therethrough into atmospheric air at room temperature at an extrusion velocity of 8.4 meters/minute and a winding up velocity of 600 meters/minute to give a pitch filament. The angle of orientation OA, apparent crystallite size $L_c$ and interlamellar distance $d_{002}$ in this pitch filament were 36.1°, 3.45 nm and 0.347 nm, respectively. Examination with a polarizing microscope indicated fine streak-wise distribution of optically anisotropic constituents in the direction of the fiber axis on the lateral surface of the pitch filament embedded in a matrix of an epoxy resin and shaved out to be exposed as is schematically illustrated in FIG. 1.

The pitch filament as the precursor of carbon fibers was infusibilized by heating without tension in an oven in an atmosphere of air by elevating the temperature from 200° C. to 300° C. at a rate of 2° C./minute and then keeping at 300° C. for 30 minutes and then subjected to the carbonization treatment in a furnace in an atmosphere of nitrogen by elevating the temperature from 200° C. to 1500° C. at a rate of 10° C./minute and then keeping at 1500° C. for 15 minutes.

The thus obtained carbon fibers of 10.8 μm diameter had a tensile strength of 245 kg/mm$^2$, an elongation of 1.4% and a tensile modulus of 17.5 tons/mm$^2$.

EXAMPLES 3 to 6

The hydrogenation treatment of a pitch was performed to give a primary pitch composition with 351 g of the same coal tar-based pitch and 1053 g of THQ in about the same manner as in the preceding example except that the reaction temperature was 450° C. instead of 430° C. The pitch composition was further heated at 465° C. for 15 minutes in an atmosphere of nitrogen under a pressure of 10 mmHg to give a pitch composition for spinning.

The thus obtained pitch composition for spinning had a density of 1.332 at 20° C. and a melt viscosity of 2450 poise at 320° C. and contained 57.6% by weight of quinoline-insoluble fraction and 89.0% by weight of toluene-insoluble fraction. The aromaticity index of the pitch composition was 0.54 and the number-average molecular weight of the quinoline-soluble fraction was 983 and the density thereof was 1.311 at 20° C.

Spinning of the above prepared pitch composition for spinning into pitch filaments was performed in about the same manner as in the preceding example except that the temperature of extrusion was 380° C. instead of 360° C. and the velocity of winding up was varied in the range of 400 to 1000 meters/minute. The infusibilization and carbonization treatments of the above obtained precursor pitch filaments were undertaken in the same manner as in the preceding example except that the rate of temperature elevation in the carbonization treatment was 15° C./minute instead of 10° C./minute.

The structural parameters of the pitch filaments determined by the X-ray crystallography and the mechanical properties of the carbon fibers are shown in Table 1 for the varied winding up velocities or the drafting ratios together with the diameters of the pitch filaments and carbon fibers.

TABLE 1

| | | Example No. | | | |
|---|---|---|---|---|---|
| | | 3 | 4 | 5 | 6 |
| Pitch filaments | Velocity of winding up, meters/min. | 400 | 600 | 800 | 1000 |
| | Drafting ratio | 47.6 | 71.4 | 95.2 | 119.0 |
| | OA, degrees | 34.8 | 37.1 | 45.2 | 46.2 |
| | $L_c$, nm | 3.62 | 3.38 | 3.08 | 2.75 |
| | $d_{002}$, nm | 0.346 | 0.347 | 0.347 | 0.347 |
| | Filament diameter, μm | 14.8 | 12.0 | 10.7 | 9.8 |
| Carbon fibers | Fiber diameter, μm | 13.8 | 11.0 | 9.7 | 8.9 |
| | Tensile strength, | 235 | 252 | 267 | 271 |

TABLE 1-continued

| | Example No. | | | |
|---|---|---|---|---|
| | 3 | 4 | 5 | 6 |
| kg/mm$^2$ | | | | |
| Elongation, % | 1.40 | 1.42 | 1.44 | 1.42 |
| Modulus, tons/mm$^2$ | 16.8 | 17.8 | 18.5 | 19.1 |

EXAMPLES 7 to 10

The same pitch composition for spinning as prepared in Examples 3 to 6 was processed into pitch filaments in the same manner as in these preceding examples except that the L/D of the spinning nozzle in the spinneret was 0.3 (mm)/0.3 (mm) and the velocity of winding up was always 600 meters/minute with varied velocity of extrusion, i.e. varied drafting ratio. The infusibilization and carbonization treatments of the precursor pitch filaments were carried out in just the same manner as in Examples 3 to 6 to give carbon fibers.

Table 2 below summarizes the structural parameters of the pitch filaments and the mechanical properties of the carbon fibers.

TABLE 2

| | | Example No. | | | |
|---|---|---|---|---|---|
| | | 7 | 8 | 9 | 10 |
| Pitch filaments | Velocity of extrusion, meters/min. | 0.5 | 1.0 | 1.5 | 2.0 |
| | Drafting ratio | 1200 | 600 | 400 | 300 |
| | OA, degrees | 45.3 | 40.5 | 37.0 | 32.2 |
| | $L_c$, nm | 2.60 | 3.24 | 3.51 | 3.94 |
| | $d_{002}$, nm | 0.347 | 0.347 | 0.346 | 0.346 |
| Carbon fibers | Fiber diameter, μm | 8.3 | 11.0 | 13.6 | 15.1 |
| | Tensile strength, kg/mm$^2$ | 283 | 271 | 231 | 221 |
| | Elongation, % | 1.40 | 1.39 | 1.36 | 1.35 |
| | Modulus, tons/mm$^2$ | 20.2 | 19.5 | 17.0 | 16.4 |

Comparative Example 10

Pitch filaments were prepared by spinning the same pitch composition for spinning as prepared in Example 2 in the same manner as in Example 2 except that the spinning temperature was 330° C. instead of 360° C. Additionally, a muffle tube of 20 cm long was provided just below the spinneret and the temperature in the tube, through which the extruded pitch filament ran, was kept at 300° C.

The angle of orientation OA, crystallite size $L_c$ and interlamellar distance $d_{002}$ in the thus obtained pitch filament were 27.8°, 4.21 nm and 0.345 nm, respectively.

The pitch filament was subjected to the infusibilization and carbonization treatment in the same manner as in Example 2 to give carbon fibers having a tensile strength of 81.3 kg/mm$^2$, elongation of 0.76% and tensile modulus of 10.8 tons/mm$^2$. The cross section of the carbon fiber formed by breaking indicated a radial structure of the crystallite orientation along with some cracks as was shown by the examination with a scanning-type electron microscope.

EXAMPLE 11

In the first place, pitch compositions for spinning containing a premesophase pitch or a combination thereof with a mesophase pitch were prepared in the following manner.

Table 3 below shows the properties of the 5 coal-based pitches A to E and a petroleum-based pitch, i.e. naphtha tar pitch, used as the starting pitch material in the preparation of the pitch compositions for spinning.

TABLE 3

| Starting pitch | Softening point, °C. | Fixed carbon, % by weight | Quinoline-insoluble fraction, % by weight | Benzene-insoluble fraction, % by weight |
|---|---|---|---|---|
| Coal-based pitch, A | 73 | 55.1 | 6.4 | 25.8 |
| Coal-based pitch, B | 90 | 57.1 | 13.6 | 33.8 |
| Coal-based pitch, C | 94 | 57.0 | 14.2 | 37.8 |
| Coal-based pitch, D | 68 | 57.2 | 4.6 | 26.6 |
| Coal-based pitch, E | 71 | 61.1 | 15.8 | 30.7 |
| Naphtha tar pitch | 148 | 65.7 | 3.7 | 49.4 |

Hydrogenation of the starting pitch was performed by introducing about 400 g of one of the above mentioned starting pitches, about 200 g of a THQ mixture containing 80.3% of THQ, the balance being quinoline, and about 20 g of red mud as a catalyst into an autoclave of 2 liters capacity and heating the mixture with agitation under pressurization with hydrogen, the initial pressure being 75 kg/cm$^2$, up to a temperature of 410° to 470° C. by elevating the temperature at an average rate of 2.5° C./minute followed by keeping the mixture at the temperature for 10 to 60 minutes, and then taking the autoclave out of the heater to cool down to room temperature.

The mixture in the autoclave was washed out with quinoline and centrifuged in a centrifugal separator. The supernatant solution was filtered with a filter paper and the residues in the centrifugal separation and filtration were combined by use of fresh quinoline and dried. The amount by subtracting the amount of the red mud added as a catalyst from the amount of the thus obtained dried residue was taken as the quinoline-insoluble fraction. The clear solution obtained by the above filtration was heated under a reduced pressure of 10 mmHg to distil off the THQ, quinoline and light oils in the starting pitch until the temperature of the mixture had reached 290° C. under the reduced pressure. The amount of the residue left by this distillation was taken as the quinoline-soluble fraction. These results together with the temperature and time of the THQ treatment are shown in table 4 below, in which the value of "Oil+gas" is the balance of the "Quinoline-insoluble fraction" and "Quinoline-soluble fraction" for the starting pitch.

TABLE 4

| Experiment No. | Starting pitch | THQ treatment | | Quinoline-insoluble fraction, % by weight | Quinoline soluble fraction, % by weight | Oil + gas, % by weight |
|---|---|---|---|---|---|---|
| | | Temperature, °C. | Time, minutes | | | |
| 1 | Coal-based pitch, A | 410 | 60 | 7.0 | 81.6 | 11.4 |
| 2 | Coal-based pitch, A | 450 | 60 | 9.5 | 77.4 | 13.1 |
| 3 | Coal-based pitch, A | 470 | 60 | 9.9 | 69.1 | 21.0 |

TABLE 4-continued

| Experiment No. | Starting pitch | THQ treatment Temperature, °C. | THQ treatment Time, minutes | Quinoline-insoluble fraction, % by weight | Quinoline soluble fraction, % by weight | Oil + gas, % by weight |
|---|---|---|---|---|---|---|
| 4 | Coal-based pitch, B | 410 | 60 | 12.6 | 76.7 | 10.7 |
| 5 | Coal-based pitch, B | 450 | 60 | 17.7 | 64.9 | 17.4 |
| 6 | Coal-based pitch, C | 410 | 60 | 13.7 | 83.0 | 3.3 |
| 7 | Coal-based pitch, D | 450 | 60 | 8.6 | 79.1 | 12.3 |
| 8 | Coal-based pitch, E | 450 | 10 | 10.2 | 78.0 | 11.8 |
| 9 | Coal-based pitch, E | 450 | 60 | 16.0 | 71.1 | 12.9 |
| 10 | Naphtha tar pitch | 450 | 60 | 10.4 | 75.2 | 14.4 |

The quinoline-soluble fractions obtained in the above preparation and shown in Table 4 were used for the preparation of the pitch compositions for spinning. Thus, about 100 g of the quinoline-soluble fraction were taken in a cylindrical glass vessel provided with a three-necked cover which was placed on the top of a furnace heated in advance at about 490° C. to preheat the quinoline-soluble fraction up to about 300° C. with simultaneous blowing of high-purity nitrogen thereinto through a glass tube. Then the glass vessel was transferred into the furnace so that the temperature of the content of the vessel reached 470° C. taking about 4 minutes followed by keeping at this temperature for 8 to 22 minutes. During this treatment, the rate of nitrogen blowing was controlled in the range from 1 to 3 liters/-minute in order to prevent refluxing of and to facilitate distillation out of the light oily materials formed by the treatment as far as possible. After completion of the treatment for the above mentioned length of time, the vessel was taken out of the furnace and cooled to room temperature. The thus obtained material left in the vessel was used as the pitch composition for spinning. Table 5 below shows the properties of the thus prepared pitch compositions for spinning together with the time of the treatment and the yield of the product based on the quinoline-soluble fraction. In this table, the Experiment Nos. correspond to those in Table 4 and indicate that the quinoline-soluble fraction used in a particular Experiment in this table was obtained in the treatment shown in Table 4 with the same number of the experiment. The Experiments Nos. 9-1 and 9-2 in Table 5 were conducted by use of the same quinoline-soluble fraction obtained in Experiment No. 9 in Table 4.

TABLE 5

| Experiment No. | Time of treatment, minutes | Yield, % by weight | Softening point, °C. | Fixed carbon, % by weight | Quinoline-insoluble fraction, % by weight | Quinoline-soluble fraction, % by weight | $T_s$, °C. | $T_s$-(softening point), °C. | Viscosity at $T_s$, poise | B for the straight line II, $\times 10^{-3}K^{-1}$ |
|---|---|---|---|---|---|---|---|---|---|---|
| 1 | 15 | 37.9 | 259 | 92.6 | 40.2 | 94.6 | 331 | 72 | 121 | 24.2 |
| 2 | 20 | 35.6 | 256 | 92.5 | 41.0 | 95.2 | 326 | 70 | 344 | 24.4 |
| 3 | 20 | 32.9 | 259 | 92.7 | 39.8 | 95.0 | 337 | 78 | 572 | 24.4 |
| 4 | 10 | 35.9 | 265 | 91.6 | 24.8 | 94.6 | 349 | 84 | 102 | 23.7 |
| 5 | 18 | 30.1 | 264 | 92.3 | 31.9 | 98.1 | 342 | 78 | 252 | 24.2 |
| 6 | 8 | 45.9 | 262 | 92.9 | 33.5 | 95.4 | 350 | 88 | 153 | 24.9 |
| 7 | 18 | 35.9 | 265 | 91.6 | 20.0 | 92.3 | 344 | 79 | 99 | 21.9 |
| 8 | 15 | 26.9 | 240 | 91.9 | 23.8 | 91.0 | 324 | 85 | 93 | 21.4 |
| 9-1 | 18 | 30.0 | 258 | 92.5 | 35.8 | 96.3 | 342 | 84 | 99 | 24.4 |
| 9-2 | 22 | 28.9 | 288 | 92.7 | 62.4 | 98.2 | 375 | 87 | 130 | 25.3 |
| 10 | 18 | 30.9 | 300 | 90.5 | 27.6 | 99.0 | 380 | 80 | 123 | 24.9 |

Meanwhile, these pitch compositions for spinning had densities in the range from 1.29 to 1.35 at 20° C. and the values of the aromaticity index and the H/C molar ratio thereof were in the ranges from 0.45 to 0.8 and from 0.5 to 0.65, respectively. The number-average molecular weights of the quinoline-soluble fractions were in the range from 700 to 1700.

Further, the viscosity behavior, i.e. the temperature-viscosity relationship, of the pitch compositions for spinning was examined by use of a double-cylinder rotation viscometer. The viscosity measurement was performed by decreasing the temperature of the pitch composition in the vessel once heated up to about 400° C. The temperature-viscosity relationship well satisfied the Andrade's equation (I) or (II) in each of the temperature regions above or below a temperature $T_s$ for each of the pitch compositions so that plotting of the logarithm of the viscosity $\eta_a$ in poise against the reciprocal of the absolute temperature in K gave a graph composed of two straight lines intersecting at the temperature of viscosity change $T_s$ as is shown in FIG. 3 which specifically gives the results obtained in Experiment No. 4 in Table 5.

Table 5 gives the values of the $T_s$, difference between the $T_s$ and the softening point ($T_s$-softening point) of the same pitch composition, viscosity of the pitch composition at $T_s$ and the value of B in the Andrade's equation for the part II of the graph plotted in a similar manner to FIG. 3, i.e. the temperature region lower than $T_s$. As is shown in Table 5, all of the pitch compositions had about the same value of B in the part II of the graphs whereas the values of B in the part I of the graphs differ considerably widely from composition to composition.

Spinning test of the above prepared pitch compositions for spinning was undertaken with a brass-made spinning apparatus provided with a spinneret with a spinning nozzle of 0.3 mm or 0.5 mm diameter. The pitch composition in the spinning apparatus was externally heated to be melted while the temperature of the pitch composition was recorded by means of a thermocouple inserted into the pitch composition. When the temperature of the molten pitch composition reached a desired temperature, the molten pitch composition was extruded out of the nozzle by pressurizing with nitrogen gas into a filament which was wound up on a winding drum at a winding up velocity of 500 to 1000 meters/- minute so as to always give a filament diameter of about 10 μm.

The pitch filaments were then subjected to the infusibilization treatment in an atmosphere of air in an oven by elevating the temperature up to 200° C. at a rate of temperature increase of 5° C./minute and then up to 300° C. at a rate of 2° C./minute followed by keeping at 300° C. for 30 minutes. The infusibilized pitch filaments were further subjected to the carbonization treatment to give carbon fibers in a stream of nitrogen by increasing the temperature at a rate of 25° C./minute up to 1000° C. followed by keeping at this temperature for 15 minutes.

Table 6 below gives some of the results of the X-ray crystallographic analysis undertaken with these carbon fibers for the values of the angle of orientation OA, crystallite size $L_c$ and interlamellar distance $d_{002}$. Further, the carbon fibers were subjected to the graphitization treatment by heating in a stream of argon up to 2800° C. in a Tammann electric furnace and keeping at this temperature for 30 minutes. Microphotographic examination of the cross section of the thus graphitized carbon fibers was undertaken by use of a scanning-type electron microscope for the lamellar structure of carbon. As is shown by this microphotographic examination, any one of the pitch compositions for spinning in Experiments No. 1 to No. 10 gave different types of cross sectional structures depending on the melt temperature in spinning classified into 5 types of: (A) a radial arrangement of the lamellae with cracks; (B) a radial arrangement with no cracks; (C) a sheath-and-core structure with coaxially circumferential lamellae in the peripheral portion and radial arrangement in the core portion; (D) a random arrangement; and (E) a coaxially circumferential lamellae throughout the cross section or the so-called onion-like structure. Table 6 also gives the cross sectional structure of each of the carbon fibers shown by either one of the above 5 types (A) to (E) in addition to the temperature and viscosity of each of the molten pitch compositions and the X-ray crystallographic parameters of the carbon fibers obtained from the pitch composition.

TABLE 6

| Pitch composition for spinning[1] | Melt temperature, °C. | Viscosity, poise | Carbon fibers | | | |
|---|---|---|---|---|---|---|
| | | | OA, degrees | $d_{002}$, nm | $L_c$, nm | Cross sectional structure[2] |
| No. 4 | 322 | 1071 | 44.8 | 0.356 | 1.45 | C |
| | 361 | 200 | 42.1 | 0.354 | 1.47 | D |
| | 390 | 50 | 37.2 | 0.350 | 1.54 | E |
| No. 9-1 | 321 | 768 | 28 | 0.351 | 1.51 | A |
| | 342 | 84 | 41.8 | 0.356 | 1.47 | C |
| | 360 | 27 | 39.8 | 0.358 | 1.41 | D |
| | 370 | 15 | 39.2 | 0.356 | 1.53 | E |

[1]See TABLE 5.
[2]See text for the meaning of symbols.

TABLE 7

| Pitch[1] | Melt temperature, °C. | Viscosity, poise | Graphitized fiber | |
|---|---|---|---|---|
| | | | Cracks | Cross sectional structure[2] |
| 1 | 365 | 16 | Yes | A |
| | 402 | 2 | No | E |
| 2 | 340 | 131 | No | B |
| | 350 | 69 | No | B |
| | 360 | 37 | No | C |

TABLE 7-continued

| Pitch[1] | Melt temperature, °C. | Viscosity, poise | Graphitized fiber | |
|---|---|---|---|---|
| | | | Cracks | Cross sectional structure[2] |
| | 370 | 20 | No | C |
| | 380 | 11 | No | C |
| | 390 | 6.5 | No | E |
| | 400 | 3.8 | No | E |
| 3 | 365 | 86 | Yes | A |
| | 374 | 50 | No | C |
| | 382 | 32 | No | E |
| | 392 | 18 | No | E |
| | 402 | 11 | No | E |
| 4 | 322 | 1071 | No | B |
| | 341 | 200 | No | C, D |
| | 361 | 50 | No | B, C |
| | 380 | 17 | No | E |
| | 390 | 10 | No | E |
| 5 | 321 | 2560 | No | B |
| | 340 | 285 | No | B |
| | 360 | 77 | No | E |
| | 380 | 24 | No | E |
| 6 | 323 | 1758 | No | B |
| | 341 | 333 | No | B |
| | 361 | 77 | No | C |
| | 380 | 25 | No | E |
| | 403 | 7 | No | E |
| 7 | 322 | 1024 | No | B |
| | 340 | 150 | No | D |
| | 360 | 41 | No | D |
| | 380 | 14 | No | D, E |
| | 400 | 5 | No | E |
| 8 | 311 | 309 | No | B |
| | 330 | 46 | No | C, D |
| | 350 | 19 | No | D |
| | 370 | 6 | No | E |
| | 382 | 4 | No | E |
| 9-1 | 321 | 768 | Yes | A |
| | 342 | 84 | No | D |
| | 360 | 27 | No | E |
| | 370 | 15 | No | E |
| 9-2 | 352 | 1058 | No | B |
| | 370 | 183 | No | B |
| | 392 | 42 | No | D |
| | 412 | 14 | No | E |
| | 422 | 8 | No | E |
| 10 | 365 | 498 | Yes | A,B |
| | 381 | 97 | Yes | A,B |
| | 401 | 32 | No | C,D |
| | 420 | 12 | No | D,E |
| | 438 | 5 | No | E |

[1]See Table 5.
[2]See text for the meaning of symbols.

EXAMPLE 12

A quinoline-soluble, optically isotropic pitch composition was prepared in substantially the same manner as in Examples 3 to 6 with 402 g of the same coal tar-based pitch and 1206 g of THQ. The density of the thus hydrogenated pitch composition was in the range from 1.25 to 1.31 at 20° C. and the average molecular weight of the structural units thereof was in the range from 200 to 400. The results of the NMR analysis indicated that this pitch composition was composed mainly of condensed polycyclic aromatic compounds with partially hydrogenated nuclei of which the number of the condensed rings was 2 to 6.

The above prepared hydrogenated pitch composition was further heat-treated at 465° C. for 15 minutes in an atmosphere of nitrogen under a pressure of 10 mmHg to give a pitch composition for spinning having a density of 1.330 at 20° C. and containing 45.0% and 85% of quinoline-and toluene-insoluble fractions, respectively. The H/C molar ratio of the pitch composition and the number average molecular weight of the quinoline-soluble fraction thereof were also within the preferable ranges.

Spinning of the above pitch composition for spinning was performed with an extrusion cylinder having the same mesh filter and the same spinneret as used in Examples 3 to 6 and further provided with a means for independent control of the temperatures at the holder section of the molten pitch and the spinneret section. The temperature of the pitch composition heated at 445° C. in the holder section was adjusted to 370° C. just before the spinneret and the pitch composition was extruded out of the spinning nozzle into atmospheric air at room temperature at an extrusion velocity of 8.4 meters/minute with winding up at a velocity of 800 meters/minute to give a pitch filament as a precursor for carbon fibers. The X-ray crystallographic analysis of this pitch filament gave 37.2° of the angle of orientation OA, 3.44 nm of the crystallite size $L_c$ and 0.347 nm of the interlamellar distance $d_{002}$.

The infusibilization and carbonization treatments of this pitch filament were undertaken in the same manner as in Examples 3 to 6 to give carbon fibers of 10.2 μm diameter having the crystallographic parameters of 36.5° of the angle of orientation OA, 2.83 nm of the crystallite size $L_c$ and 0.350 nm of the interlamellar distance $d_{002}$ and the mechanical properties of 282 kg/mm$^2$ of the tensile strength, 1.40% of the elongation and 20 tons/mm$^2$ of the tensile modulus, i.e. much superior mechanical properties to those of conventional pitch-based carbon fibers.

The microphotographic examination of the carbon fibers by use of a scanning-type electron microscope indicated that the fiber had a sheath-and-core structure composed of the peripheral portion having a thickness of 48.7% of the radius of the fiber with circumferential coaxial arrangement of the carbon layers and the core portion with radial arrangement of the crystallites.

EXAMPLE 13

A quinoline-soluble, optically isotropic pitch composition was prepared with 351 g of the same coal tar-based pitch and 1053 g of THQ in substantially the same manner as in the preceding example except that the temperature was 410° C. instead of 450° C. and the reaction time was extended to 60 minutes. Further heat treatment of this hydrogenated pitch composition at 470° C. for 15 minutes in an atmosphere of nitrogen under a pressure of 10 mmHg gave a pitch composition for spinning containing 43.5% of the quinoline-insoluble fraction and having a temperature of viscosity change $T_s$ at 331° C. The density and the H/C molar ratio of this pitch composition for spinning were also within the preferable ranges and the number-average molecular weight of the quinoline-soluble fraction was in the range of 700 to 1700.

Spinning of the above pitch composition for spinning was performed in the same manner as in the preceding example except that the pitch composition was preheated at 440° C. in the holder section of the extrusion cylinder followed by rapid temperature decrease to 380° C. just before the spinneret and the velocity of winding up was 400, 600, 800 or 1000 meters/minute in Experiments No. 13-1 to No. 13-4, respectively.

The pitch filaments obtained in the above described manner were subjected to the infusibilization and carbonization treatments in the same manner as in the preceding example under the tension by their own weight to give carbon fibers having the X-ray crystallographic parameters and the mechanical properties as shown in Table 8 below.

TABLE 8

| | | Experiment No. | | | |
|---|---|---|---|---|---|
| | | 13-1 | 13-2 | 13-3 | 13-4 |
| Pitch filaments | Velocity of winding up, meters/min. | 400 | 600 | 800 | 1000 |
| | Drafting ratio | 47.6 | 71.4 | 95.2 | 119.0 |
| | OA, degrees | 36.5 | 36.9 | 38.2 | 40.8 |
| | $L_c$, nm | 3.02 | 2.91 | 2.54 | 2.07 |
| | $d_{002}$, nm | 0.349 | 0.349 | 0.350 | 0.350 |
| Carbon fibers | Fiber diameter, μm | 13.5 | 11.2 | 9.8 | 8.7 |
| | Tensile strength, kg/mm$^2$ | 232 | 272 | 280 | 291 |
| | Elongation, % | 1.38 | 1.40 | 1.41 | 1.41 |
| | Modulus, tons/mm$^2$ | 16.8 | 19.4 | 19.9 | 20.6 |

Comparative Example 11

A pitch composition for spinning containing 40.3% of the quinoline-insoluble fraction and having a temperature of viscosity change $T_s$ at 325° C. was prepared in just the same manner as in Example 1. Spinning of this pitch composition was performed in the same manner as in Example 12 except that each of the holder section and the spinneret section of the extrusion cylinder was kept at 350° C. and the velocity of winding up was 500 meters/minute. Further, a muffle tube of 60 cm length was provided just below the spinneret and the temperature inside was kept at 320° C. so that the extruded pitch filament was cooled and solidified after passing through the atmosphere at this temperature. The angle of orientation OA of the thus obtained pitch filament was 27°.

The infusibilization and carbonization treatments of this pitch filament were undertaken in the same manner as in Example 12 to give carbon fibers having the X-ray crystallographic parameters of 24.0° of the angle of orientation OA, 7.0 nm of the crystallite size $L_c$ and 0.345 nm of the interlamellar distance $d_{002}$ and the mechanical properties of 83 kg/mm$^2$ of the tensile strength, 0.65% of the elongation and 12.8 tons/mm$^2$ of the tensile modulus.

The examination of the cross section of the thus obtained carbon fibers by use of a scanning-type electron microscope indicated that the arrangement of the crystallites therein was radial with large cracks almost reaching the center of the fiber cross section.

What is claimed is:

1. A method for the preparation of a pitch composition for spinning containing at least 30% by weight of quinoline-soluble fraction, the average molecular weight of the quinoline-soluble fraction being in the range from 700 to 1700, and having a density of 1.29 to 1.40 g/cm$^3$ at 20° C. and an aromaticity index of 0.45 to 0.9, which comprises the steps of admixing 100 parts by weight of a bituminous material with 30 to 100 parts by weight of tetrahydroquinoline, heating the mixture at a temperature in the range from 300° to 500° C. for 10 to 60 minutes and further heating the mixture at a temperature in the range from 450° to 550° C. for 5 to 60 minutes after or with simultaneous removal of the tetrahydroquinoline.

2. The method as claimed in claim 1 wherein the bituminous material is a coal tar pitch.

3. A method of producing a pitch composition for spinning pitch filaments, said method comprising the steps of admixing 100 parts by weight of a coal tar pitch material with 30 to 100 parts by weight of tetrahydroquinoline, heating the mixture at a temperature in the range from 300° to 500° C. for 10 to 60 minutes and further heating the mixture at a temperature in the range from 450° to 550° C. for 5 to 60 minutes after or with simultaneous removal of the tetrahydroquinoline, said composition containing at least 30% by weight of quinoline-soluble fraction, the average molecular weight of the quinoline-soluble fraction being in the range from 700 to 1700, and having a density of 1.29 to 1.40 g/cm$^3$ at 20 °C. and an aromaticity index of 0.45 to 0.9.

4. A method for the preparation of a pitch filament for forming a carbon fiber having a tensile strength of at least 200 kg/mm$^2$ by carbonization treatment at 1500° C. characterized by X-ray crystallographic parameters of the angle of orientation in the range from 30° to 50°, crystallite size in the range from 2.5 to 4.0 nm and interlamellar distance in the range from 0.343 to 0.350 nm which comprises heating the pitch composition produced by the method of claim 3 to a temperature higher than the temperature Ts of viscosity change to form molten pitch, rapidly decreasing the temperature of the pitch by 40° to 80° C., and then immediately spinning by extrusion, with a winding up velocity in the range from 300 to 1500 meters/minute to give a drafting ratio of at least 30.

5. The method of claim 4 wherein said step of rapidly decreasing the temperature of the pitch comprises rapidly decreasing the temperature to a temperature above the temperature Ts of viscosity change.

6. The method of claim 4 wherein said step of rapidly decreasing the temperature of the pitch comprises decreasing the temperature to below the temperature Ts of viscosity change, sufficiently rapidly to maintain the optical phase texture of the molten pitch which existed above the temperature Ts of viscosity change.

7. A method for the preparation of a pitch filament for forming a carbon fiber having a tensile strength of at least 200 kg/mm$^2$ by carbonization treatment at 1500° C. characterized by X-ray crystallographic parameters of the angle of orientation in the range from 30° to 50°, crystallite size in the range from 2.5 to 4.0 nm and interlamellar distance in the range from 0.343 to 0.350 nm which comprises heating the pitch composition produced by the method of claim 3 to a temperature higher than the temperature Ts at which the optical anisotropy of mesophase pitch disappears to form molten pitch, rapidly decreasing the temperature of the pitch by 40° to 80° C., and then immediately spinning by extrusion, with a winding up velocity in the range from 300 to 1500 meters/minute to give a drafting ratio of at least 30.

8. The method of claim 7 wherein said step of rapidly decreasing the temperature of the pitch comprises rapidly decreasing the temperature to a temperature above the temperature Ts.

9. The method of claim 7 wherein said step of rapidly decreasing the temperature of the pitch comprises decreasing the temperature to below the temperature Ts, sufficiently rapidly to maintain the optical phase texture of the molten pitch which existed above the temperature Ts.

10. A method for the preparation of a pitch-based carbon fiber having a tensile strength of at least 200 kg/mm$^2$ and a tensile modulus of at least 10 tons/mm$^2$ which comprises the steps of producing a pitch composition containing at least 30% by weight of quinoline-soluble fraction, the average molecular weight of the quinoline-soluble fraction being in the range from 700 to 1700, and having a density of 1.29 to 1.40 g/cm$^3$ at 20° C. and an aromaticity index of 0.45 to 0.9, said composition being produced by the method comprising the steps of admixing 100 parts by weight of a bituminous material with 30 to 100 parts by weight of tetrahydroquinoline, heating the mixture at a temperature in the range from 300° to 500° C. for 10 to 60 minutes and further heating the mixture at a temperature in the range from 450° to 550° C. for 5 to 60 minutes after or with simultaneous removal of the tetrahydroquinoline, spinning the pitch composition to form a pitch filament characterized by X-ray crystallographic parameters of the angle of orientation in the range from 30° to 50°, the crystallite size in the range from 2.5 to 4.0 nm and the interlamellar distance in the range from 0.343 to 0.350 nm, infusibilizing the pitch filament by heating at a temperature from 250° to 350° C. for 5 to 350 minutes in the presence of oxygen, and carbonizing the thus infusibilized pitch filament by heating at a temperature of 1000° to 1500° C. for 10 to 30 minutes in an inert atmosphere.

* * * * *